US005483998A

United States Patent [19]

Marelin et al.

[11] Patent Number: 5,483,998

[45] Date of Patent: Jan. 16, 1996

[54] ANCHORING OF A BAND BUCKLE IN A BAND CLAMP

[75] Inventors: Miklos Marelin, Aurora; George Jansen, Denver; Hans R. Hinnen, WheatRidge, all of Colo.

[73] Assignee: Band-It-Idex, Inc., Denver, Colo.

[21] Appl. No.: 163,815

[22] Filed: Dec. 6, 1993

Related U.S. Application Data

[63] Continuation-in-part of Ser. No. 594,377, Oct. 5, 1990, Pat. No. 5,127,446.

[51] Int. Cl.[6] ..... B21F 09/02

[52] U.S. Cl. ..... 140/93.4; 140/150

[58] Field of Search ..... 140/93 R, 93.4, 140/150, 152; 24/21, 22, 23 R, 23 B, 23 W

[56] References Cited

U.S. PATENT DOCUMENTS

| | | | |
|---|---|---|---|
| 1,649,363 | 11/1927 | Parsons . | |
| 1,670,201 | 5/1928 | McGary . | |
| 1,887,732 | 11/1932 | Pagel et al. | 140/152 |
| 1,948,719 | 2/1934 | King | 140/150 |
| 2,075,720 | 3/1937 | Hoffmann | 81/9.1 |
| 2,087,655 | 7/1937 | Prestwich | 81/9.1 |
| 2,208,134 | 7/1940 | McAneny | 81/9.3 |
| 2,214,110 | 9/1940 | Ott | 140/152 |
| 2,349,608 | 5/1944 | Bramble | 254/79 |
| 2,928,434 | 3/1960 | McAneny | 140/93.4 |
| 3,344,815 | 10/1967 | Lawson et al. | 140/123.6 |
| 3,552,450 | 1/1971 | Plunkett | 140/93.4 |
| 4,041,993 | 8/1977 | Angarola | 140/123.6 |
| 4,646,393 | 3/1987 | Young | 24/20 R |
| 4,696,327 | 9/1987 | Wolcott | 140/150 |
| 4,726,403 | 2/1988 | Young et al. | 140/93.4 |
| 4,733,701 | 3/1988 | Loisel et al. | 140/93.2 |
| 4,928,738 | 5/1990 | Marelin et al. | 140/93.4 |
| 4,934,416 | 6/1990 | Tonkiss | 140/93.2 |
| 5,000,232 | 3/1991 | Wolcott | 140/93.4 |
| 5,007,465 | 4/1991 | Tonkiss | 140/150 |

FOREIGN PATENT DOCUMENTS

| | | | |
|---|---|---|---|
| 658135 | 2/1963 | Canada | 140/117 |
| 0174410 | 3/1986 | European Pat. Off. . | |

*Primary Examiner*—Lowell A. Larson
*Attorney, Agent, or Firm*—Sheridan Ross & McIntosh

[57] ABSTRACT

The present invention provides a band clamp with an improved lock between the band and the buckle of the band clamp. The improved lock is of the type of lock where the band is passed through the buckle and then shaped to form a locking surface that engages the exterior of the buckle to prevent the band from being pulled back through the buckle. Characteristic of the improved lock is that the lateral cross-section of the locking surface is, in one embodiment substantially V-shaped. In other embodiments, the lateral cross-section is substantially U-shaped and substantially Ω-shaped. In a further embodiment, a banding tool is disclosed for use with a band and a buckle separate from the band, wherein the banding tool forms both a band lock on one band end and a retaining member on the opposite band end such that the retaining member inhibits the non-attached buckle from separating from the band during lock formation.

19 Claims, 30 Drawing Sheets

544
548b
548a
552
540
556
306
128
304

544
224
564
540
556
306
504
512a
512b
568
304

308
128
224
548b
552
540
346
544
548a
389
302
300a 308
300a
302
302
324
304
504
308
17

544
389
568a
560
346
302
540
568b
300a

560

404
306
304
406

404
224
604
600
304
406

300a
304

404
304
128
308
224
406
302
600
300a
17

ANCHORING OF A BAND BUCKLE IN A BAND CLAMP

CROSS-REFERENCE TO RELATED APPLICATION

This application is a continuation-in-part application of prior application Ser. No. 07/594,377, filed Oct. 5, 1990, now U.S. Pat. No. 5,127,446.

TECHNICAL FIELD OF THE INVENTION

This invention relates in general to securing a band to a buckle of a band clamp, and in particular to an improved lock between a band and a buckle as well as an apparatus and method for forming the improved lock.

BACKGROUND OF THE INVENTION

The use of a hand tool to tighten a band clamp has long been known. Band clamps are typically used to secure bundles of materials together and to secure pipes, wiring, etc. In one such application, a band clamp is applied to secure a protective metal braiding around a bundle of wiring which is connected to a plug or coupler known as a back shell.

Back shells are frequently used in military and aerospace applications where wiring carrying low voltage signals are conducted. Both the cables and the connectors must be protectively covered with a metallic substance to limit the harmful effects of radiation thereon. This metallic shielding must be without any "windows" (openings) and must in all parts have a ground connection with only low resistance to effectively minimize any electrical potential this "shielding" system may receive due to external or internal electromagnetic radiation (such as radio emission, cosmic rays, lightning strike, explosion of an atomic device, etc.). The diameter of the back shell body is typically larger than the diameter of the cable entering thereinto, and in order to have a satisfactory interconnection, a banding tool must be capable of applying a band clamp proximate the intersection of the back shell body and the cable, entry stem. Thus the banding tool should be approximately the same width as the band clamp to be applied and should be capable of applying the band clamp from any direction.

One tool for tightening band clamps to a back shell is disclosed in U.S. Pat. No. 4,726,403, to Young et al., Feb. 23, 1988. The Young et al. device uses a toggle arrangement to tension the band clamp in place. Upon reaching the appropriate tension in the band clamp, the tool locks in a closed condition. To sever the tail from the tightened band clamp, a cutting arm must be rotated outwardly and upwardly from the side of the banding tool.

Due to the externally attached cutting device, the Young et al. banding tool is capable of applying a band clamp close to the back shell from only one direction. If a band is attempted to be connected from the opposite direction, the cutting device may prevent proper installation. The Young et al. tool is therefore limited in its application and becomes difficult to operate in confined spaces such as are found in aircraft fuselages.

Additionally, Young's tool uses toggles to transfer tension and toggles generally have a short power stroke in order to make the tool usable by an average person. Therefore, a larger size tool is required to sufficiently tension the band.

Another banding tool is disclosed in U.S. Pat. No. 4,928,738 to Marelin et al., May 29, 1990, assigned to the same assignee as the present invention. The '738 tool uses toggles to provide the power stroke and counteracting springs to achieve the desired tension in a band. It is necessary to force the band to bend around internal portions of the tool during tensioning. Additionally, the tool is not designed with overall width as a primary consideration.

Still another banding tool is disclosed in U.S. Pat. No. 2,087,655 to Prestwich, Jul. 20, 1937, the '655 device has a gripper section which holds one end of the band to be tensioned while a tensioning section grips and pull the other end of the band. The tensioning section comprises a double set of knurled wheels with a first set fixed and a second set movable. While the first set prevents slippage of the band, the second set tensions the band. While there is an angle between the tensioning section and the gripper section, this angular relationship does not provide the advantages of the present invention. Thus there is a need for a method and apparatus to allow tensioning of a band clamp to a back shell from either direction.

An additional concern is the lock established between the band and the buckle of a band clamp. Particularly, the type of lock that is of concern is one in which the free end of a band, whose other end is operatively attached to a buckle, is wrapped about an object and inserted through a passageway extending through the buckle and then bent to create a surface which engages the exterior of the buckle preventing the band from pulling back through. The lock itself is defined by the engagement of the band to the exterior of the buckle. For example, in one lock of this type known to those skilled in the art, the lock is formed by bending the band transverse to the length of the band and away from the object about which the band clamp is wrapped to create the surface, a lip, which engages the upper exterior surface of the buckle to lock the band in place.

The known locks of the type that are formed by bending the band to create a surface that engages the exterior surface of the buckle suffer from many deficiencies and inadequacies. Particularly, a problem prevalent among known locks of this type is their lack of holding power in certain circumstances. One such circumstance is when the lock is used to secure a band clamp about an object which is capable of expansion and contraction. In this situation, the known locks of the aforementioned type are susceptible to failure upon expansion of the object. Consequently, there is a need for a lock of the aforementioned type that exhibits improved strength in these and like circumstances.

A further problem of known locks of the stated type is the force required of the banding tool to create the lock. In many instances, the force necessary to create the locks necessitates the use of a power tool or if a hand tool is employed, considerable force must typically be applied by the operator. For example, in the lock in which the band is bent transverse to its longitudinal axis and away from the object about which the band clamp is wrapped, the devices presently used to shear off the excess band make the entire cut at one time. Further, the force necessary to make the entire cut at once increases as the width of the band increases and as the thickness of the band increases. However, the use of a power tool is not practical in many applications. Similarly, in many situations it is not possible for an operator to apply the requisite force to a hand tool. Consequently, there is a further need for a lock that can be readily formed with hand banding tools.

An additional problem in the aforementioned type of lock is its susceptibility to snagging. Specifically, the known locks of this type are formed in a manner in which they are susceptible to failure due to edges of the lock snagging on articles that can destroy the lock between the band and the buckle by "unbending" the band. For example, the lock formed by bending the band transverse to its longitudinal axis typically has an exposed edge where the excess band has been sheared that is readily snagged. Further, the snagged edge of the lock may damage the material or object that has been snagged. As is apparent, there is a further need for a lock of the defined type that is less susceptible to snagging.

A further problem in the known locks of the aforementioned type is their susceptibility to tampering. For example, the known lock in which the edge of the band is bent away from the object about which the band is wrapped can be defeated with simple tools, such as a pair of pliers, and by hand in some instances. Therefore, there is an additional need for a lock of the defined type that is less susceptible to tampering.

A further problem for locks of the aforementioned type, and especially those in which the band is bent transverse to the length of the band to create a lip that engages the upper exterior surface of the buckle, is that the tool which is used to create the lock and the clamped object must be rotated relative to one another to form the lip. During this rotation process, it is necessary to release some of the tension in the band to prevent the portion where the lock is to be established from thinning or breaking. Hence there is a need for a lock that can be formed while substantially avoiding having to release tension in the band, relative rotation between the band and the clamped object, or thinning of the band in the lock area due to rotation. Concomitantly, there is a need for a tool for forming such a lock.

A further problem of the known locks of the aforementioned type is the inability of one banding tool to create the locks with various widths of the band. Consequently, a separate banding tool must be acquired for each width of band and associated buckle that is employed. Hence, there is a need for a lock that can be formed in band clamps of varying widths by one banding tool.

An additional problem of the known locks is their relative short life. Band clamps are often used in circumstances where they are unprotected from various elements, including the weather, and under great force. In these circumstances, the formation of known locks do not provide the long-life characteristics desired.

A further problem of the known locks is the difficulty in forming a proper lock in circumstances wherein the bundle or object sought to be secured is, for example, at a remote location. The known locks are inadequately designed to be formed by hand-held tools as opposed to machine tools, due to the forces required to form the lock.

Based on the foregoing, there exists a need for an improved lock for a band clamp that is of the type in which the band is bent to form a surface that engages the exterior surface of the buckle and method for making same that exhibits improved strength characteristics. Among other things, there exists a need for a lock of this type that exhibits improved strength characteristics, that can be readily made with hand tools as well as mechanized tools, that is less susceptible to snagging, that is tamper resistant, that permits a single tool to be used to create a lock in band clamps of different widths, and that can be formed while substantially avoiding the release of any tension in the band, relative rotation in the band, rotation between the band and the clamped object, or thinning of the buckle. Moreover, there is a need for a tool and method for forming such a lock.

SUMMARY OF THE INVENTION

The present invention disclosed herein comprises a method and apparatus for a banding tool using a force storing device which substantially eliminates or reduces problems associated with prior banding tools. The present invention allows the installation of a band to a coupling in which the tool must be placed proximate the coupling from either side thereof.

In accordance with one aspect of the invention, a tool for tensioning a band is provided. The tool comprises a tensioning means having a first longitudinal axis therethrough. Means for transferring tension from the tensioning means to the band is interconnected to the tensioning means at an angle thereto.

The tensioning means comprises a force storing device within a hollow handle of the tool. A tension adjustment plunger, a tension adjustment screw and a connecting rod are interconnected to the force storing device and the means for transferring tension. In a preferred embodiment the force storing device comprises a compression spring which is precompressed a desired amount by the adjustment plunger.

The means for transferring tension comprises a tension transfer lever interconnected to the tensioning means and a tensioning block. At least one push link is connected on a first end thereof to the tensioning means and on a second end to the lever arm. A tension block having an elongated slot and a tension pin therein is connected to the lever arm, wherein the tension block pulls the band into tension.

It is a technical advantage of the present invention that a band may be tensioned around a back shell from either direction. It is a further advantage of the present invention that a precompressed spring is used for achieving a desired tension in the band. It is a still further advantage of the present invention that levers are used to transfer tension rather than toggles resulting in a more work efficient tool.

The present invention disclosed herein further comprises a band clamp with an improved lock of the type in which the band is bent to create a surface that engages an exterior surface of the buckle and method for making such an improved lock which addresses the problems associated with known locks of this type. Accordingly, the present invention provides a lock that is formed by engaging the band with the buckle in a manner to increase the strength of the resulting lock. This is accomplished, at least in part, by bending the band along a line that is other than transverse to the passageway of the buckle or to the longitudinal axis of the band to establish the surface which engages the exterior of the buckle in contradistinction to the known locks of this type. This way of forming the lock contributes to the ability of the lock to withstand greater forces.

In accordance with one embodiment of the invention, the edges of the band are bent to form a locking surface with a substantially V-shaped transverse cross-section for engaging an external portion of the buckle. Further, the end of the band is cut in a manner that does not require a cutting edge to make the entire cut at one time. In one embodiment, this is achieved by cutting the band along a curve. Formed in this way, the lock can be readily formed by a hand banding tool as well as a powered banding tool.

In accordance with another embodiment of the invention, the edges of the band are bent to form a surface for engaging the exterior of the buckle that has a substantially "U" shaped transverse cross-section. Formed this way, in order for the lock to fail, the edges engaging the exterior of the buckle must be defeated along their entire length. As consequence, the instant invention provides a strong and generally long-lasting lock.

In accordance with a further embodiment of the invention, a portion of the band located intermediate to the lateral edges of the band is bent substantially parallel to the passageway of the buckle to create the surface that engages the exterior of the buckle to form a lock. Stated another way, the band is bent in a manner that produces a substantially Ω-shaped transverse cross-section. Formed in this way, the exposed edges are reduced thereby reducing the chances that the integrity of the lock will be compromised.

In a further embodiment of the invention, a lock cover is added to the upper portion of the buckle to protect the aforementioned Ω-shaped lock against tampering. Further, the lock cover and lock permit a banding tool to be designed that can be used to form the lock with bands and buckles of various widths.

In yet a further embodiment of the invention, the band and the buckle are separate. Thus, in addition to forming a band locking surface, the banding tool is used to form a retaining member on the band such that, when the band is inserted into a passageway of the buckle, the retaining member inhibits the buckle from slipping off the band. Moreover, it is noteworthy that the retaining member and the locking surface are formed by the same embodiment of the banding tool.

In a further embodiment of the invention, an embodiment of the banding tool is provided that is useful for forming both a retaining member and a locking surface and is both pneumatically controlled and powered. Thus, the forces required for forming the retaining member, the locking surface and the tensioning of the band are produced by pneumatic cylinders.

Based on the foregoing, the present invention provides a lock which is able to withstand greater forces, and in various embodiments is long lasting, less susceptible to snagging or tampering, able to be easily formed, and can be formed while substantially avoiding the release of tension in the band, relative rotation between the band and the clamped object, or thinning of the band in the regions of the lock due to this rotation. The present invention, in at least one embodiment, provides a lock so that a banding tool can be designed to accommodate band clamps of various widths. Furthermore, the present invention provides a tool and a method for forming such a lock.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION OF THE INVENTION

Figure 1:
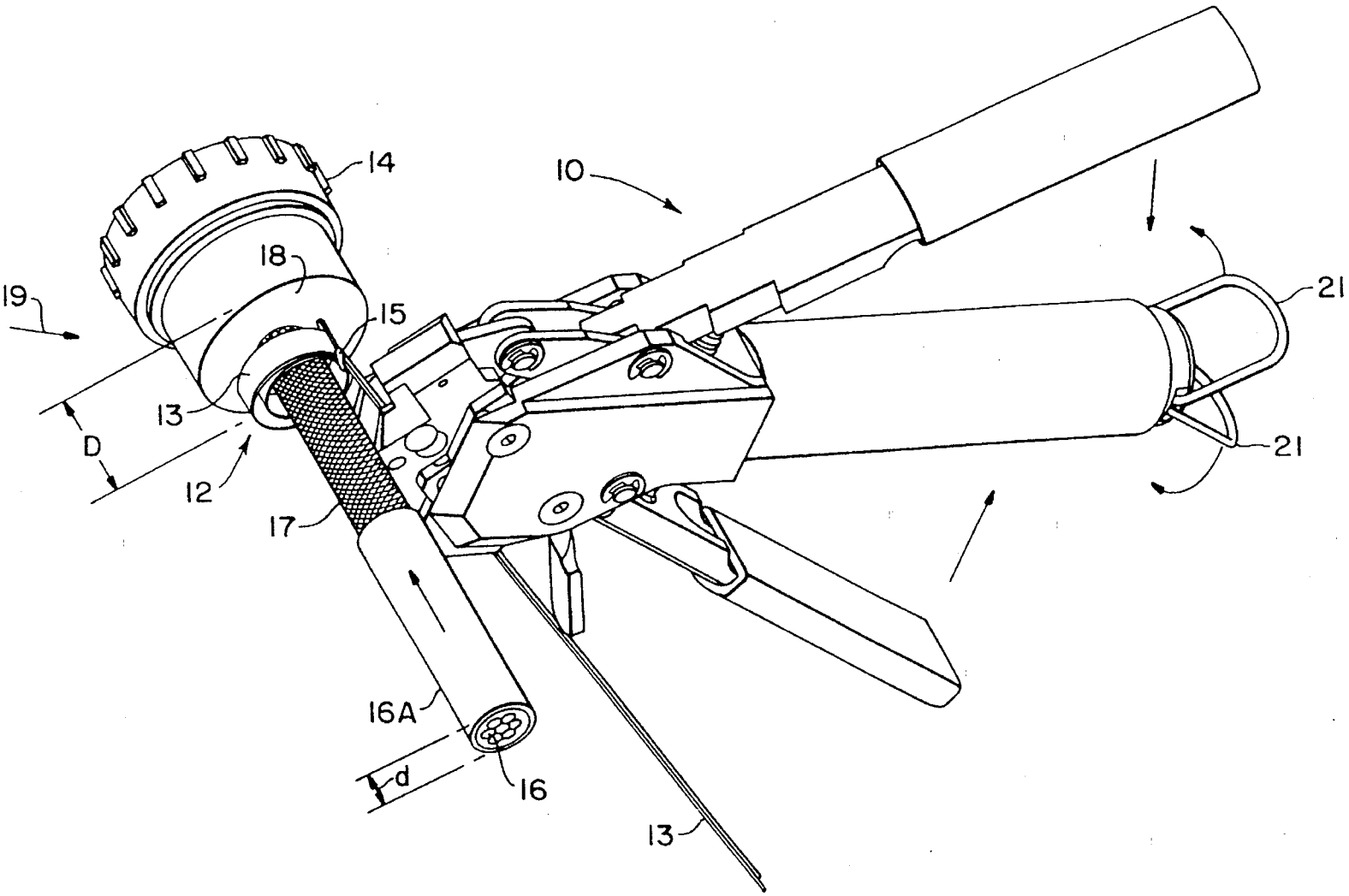
FIG. 1 is a perspective view of a tool constructed in accordance with the preferred embodiment of the present invention in use.

Referring first to FIG. 1, a perspective view of a tool constructed in accordance with the preferred embodiment of the present invention is generally identified by the reference numeral 10. The banding tool 10 is used to attach a band clamp 12 comprising a band 13 and a buckle 15 to a coupler 14 such as, for example, a back shell. The band clamp 12 is used to secure a protective shield 17 covering a cable 16 which is in turn attached to the coupler 14. Optional protective cover **16*a* such as heat shrink tubing can be installed to cover the shield 17 and the buckle 15**.

Due to a larger diameter D of the coupler 14 in comparison to a diameter d of the shield 17, a flange 18 is formed proximate the connection therebetween. As a result of the banding tool 10, the band clamp 12 may be positioned proximate the flange 18 as required for the preferred connection configuration. Also, due to the symmetrical design of the tool 10, the band clamp 12 may be positioned proximate the flange 18 from either direction (i.e., the tool 10 may also be used to apply the clamp 12 from a direction indicated by an arrow 19, directly opposite the direction as shown in FIG. 1) with equal success. It should be noted that the tool 10 may be provided with handle locks 21 that allow the tool 10 to be stored in a more compact and space efficient manner.

Figure 2A:
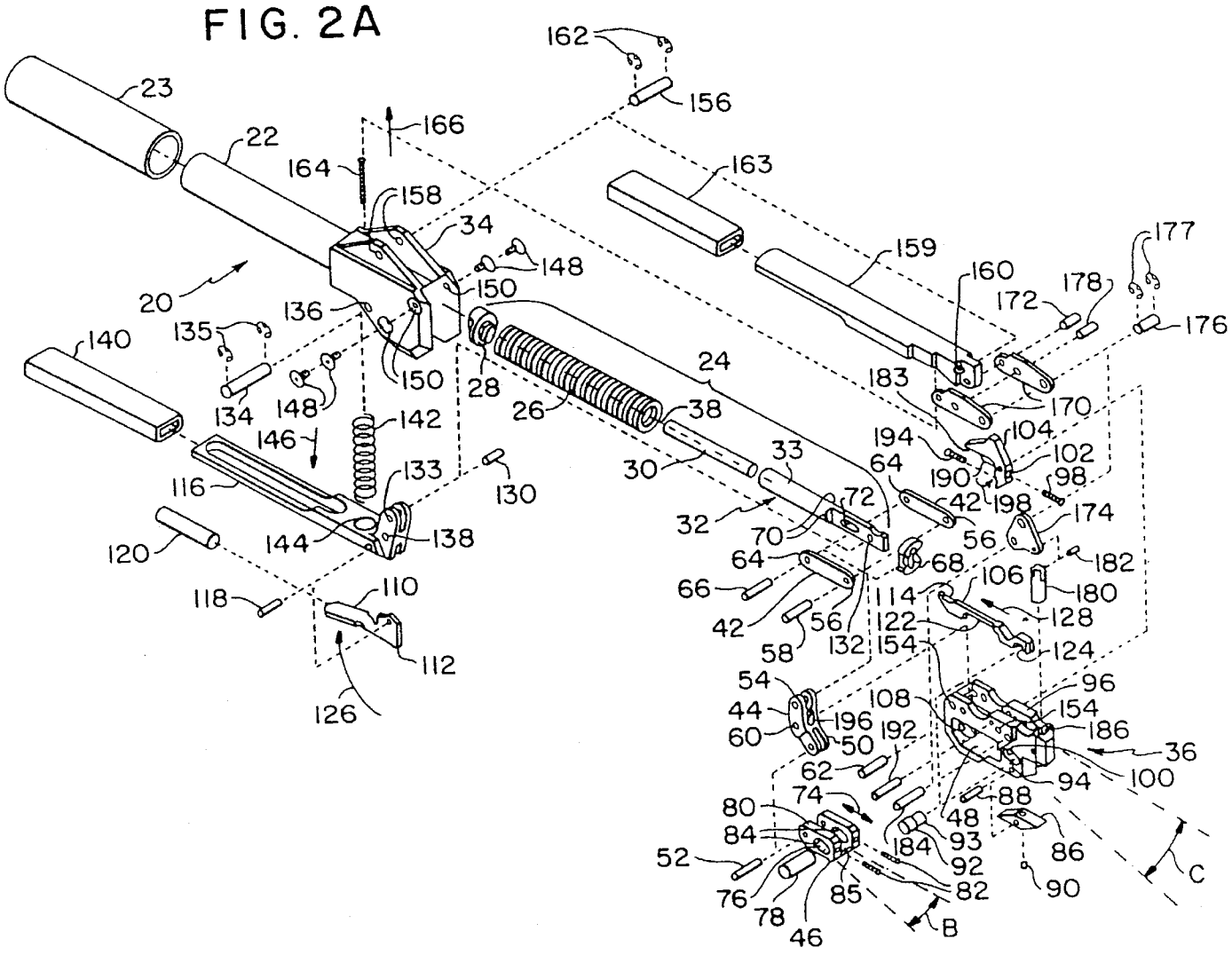
FIGS. 2A, B, and C are exploded perspective views of the tool of the present invention.
Figure 2C:
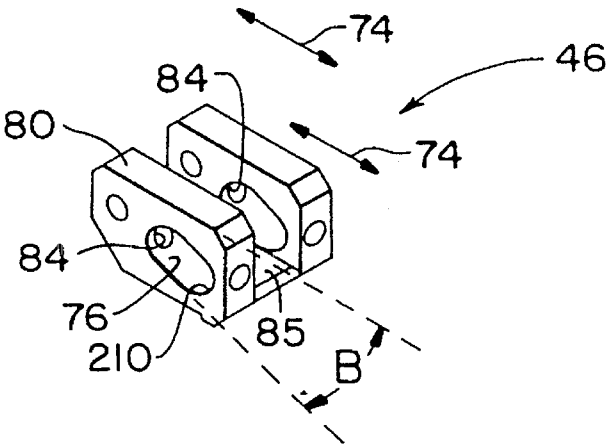
Figure 2B:
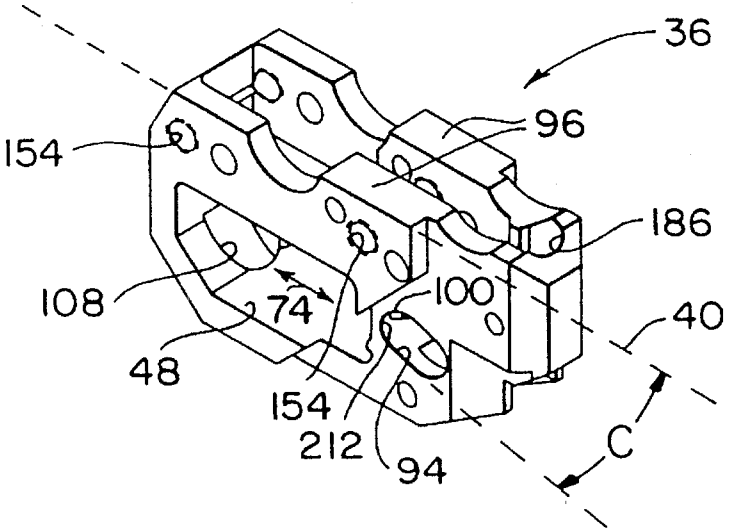

Referring simultaneously to FIGS. 2A, 2B and 2C, an exploded perspective view of the tool 10 is shown. A housing 20 receives and interconnects the various parts of the tool 10. Within a hollow handle 22 (the handle 22 may be provided with a protective covering 23 of a pliant material for comfort during use) of the housing 20 is a tensioning assembly 24. The tensioning assembly 24 comprises a force storing device 26, a tension adjustment plunger 28, a tension adjustment screw 30 and a connecting rod 32. The device 26 may comprise, for example, a compression spring, a rubber block or any other device capable of storing energy. Alternatively, the device 26 may comprise a power unit such as a hydraulic or pneumatic cylinder for powered actuation of the tool 10.

The screw 30 is threadably received into a tubular portion 33 of the rod 32. The plunger 28, upon assembly, is secured to the adjustment screw 30 to precompress the device 26 by threading into or out of the tubular portion 33 of the rod 32. A special tool (not shown) is preferably required to turn the plunger 28 and thus the screw 30 to prevent unauthorized changing of the setting of the desired recompression of the device 26. As will be subsequently described in greater detail, the device 26 is precompressed to allow a desired tension to be applied to the band clamp 12 around an object to be clamped.

The housing 20 also comprises a head receptacle 34 in which a head 36 (See: FIG. 2B) is operably interconnected to the tensioning assembly 24. It is an important aspect of the present invention to note that upon assembly, a linear axis 38 passing through the tensioning assembly 24 intersects a linear axis 40 through the head 36 at an angle A (see FIG. 3A). The angle A may vary so long as the axis 38 and the axis 40 are not parallel to each other. The angular relationship between the assembly 24 and the head 36 allows the band 13 to be inserted into and through the tool 10 without the necessity of bending around an obstruction in the tool 10. Therefore, in comparison to prior devices the tool 10 is easy to load and most of the force in the tool 10 is used to tension the band 13 rather than to bend the band 13 around an obstruction.

The head 36 is interconnected to the assembly 24 by push links 42, tension transfer lever 44 and tension block 46. The tension block 46 is slidably inserted into a cavity 48 in the head 36 and connected to a first end 50 of the lever 44 by a pin 52. The lever 44 is also pivotally connected through a center hole 60 to the head 36 by a pin 62. A second end 54 of the lever 44 is pivotally connected to a first end 56 of the links 42 by a pin 58.

The links 42 are connected at a second end 64 to the connecting rod 32 by a pin 66. A support plunger 68 is secured to the rod 32 forcing pin 66 against forward end of elongated slot 72 on the rod 32 through which the pin 66 is positioned. Due to the slot 72, the pin 66 has a predetermined travel distance along the linear axis 38, as will be subsequently described in greater detail.

The cavity 48 in the head 36 is dimensioned to allow the tension block 46 to slide in a back-and-forth direction as indicated by a double-headed arrow 74. Received within an elongated slot 76 (see FIG. 2C) in the tension block 46 is a tension pin 78. The slot, 76 is formed at an angle B (which may comprise, for example 10°–17°) relative to a top surface 80 of the block 46 to allow pressure to be applied and released by the tension pin 78 to the band 13 of the band clamp 12, as will be subsequently described in greater detail. A pair of springs 82 are inserted into holes 84 in the block 46 to bias the pin 78 toward an edge 210 (see FIG. 2C) of the slot 76 and into contact with the band 13 of the band clamp 12 which passes therebetween and a bottom surface 85 of the block 46.

A tension holding pin 92 is slidably received within an elongated slot 94 in the head 36. The pin 92 is held within the slot 94 by engagement of a groove 93 therein by a tension hold/release link 106. Thus the width of the tool 10 at the head 36 is kept to approximately the same width as the buckle 15.

The slot 94 is formed at an angle C (which may comprise, for example, 10°–17°) relative to a top surface 96 of the head 36 (see FIG. 2B). The pin 92 is biased away from an edge 212 of the slot 94 by a spring 98 which fits through the head 36 in opening 100. The spring 98 is held in place by a recess 102 in a tension holding hook 104. The band 13 of the band clamp 12 is gripped between the tension holding pin 92 and a cut-off blade 86. Thus the tension holding pin 92 is biased to hold the band 13 from slipping or being pulled from the tool 10. The cut-off blade 86 may be reversibly fixed within the head 36 by a pin 88. A jam screw 90 is threadable into the blade 86 to hold pin 88 in place and to provide convenient means to remove cut-off blade 86.

The tension hold/release link 106 fits within the head 36 through an opening 108 for cooperation with a tension hold/release hook 110. The link 106 and hook 110 are interconnected by the mating of a male portion 112 on the hook 110 with a slot 114 on the link 106. The hook 110 is pivotally connected to a pull-up handle 116 by a pin 118. The hook 110 may be provided with a pliant cover 120 for comfort of use.

The link 106 has a first cut-out 122 and a second cut-out 124. When the link 106 is installed within the head 36, the first cut-out 122 interacts with the tension pin 78 of the tension block 46 while the second cut-out 124 interacts with the tension holding pin 92 within the elongated slot 94 of the head 36. By actuating the hook 110 in a direction indicted by an arrow 126 the hook 110 pivots about the pin 118 to pull the link 106 in a direction indicated by an arrow 128.

The first cut-out 122 and the second cut-out 124 thus contact the tension pin 78 and the tension holding pin 92, respectively, and pull the pins against their spring bias. Thus, an operator is able to insert a band 13 of the band clamp 12 without interference from the tool 10.

The link 106 also provides an automatic self adjustment when clamping various materials such as steel versus rubber. For example, if the band clamp 12 encircles a rubber tube, there will be a greater tendency (than with steel) for the rubber to try to re-expand and to pull the tension holding pin 92 into the elongated slot 94 away from the edge 212 (thus gripping the band 13 tighter). This forward motion of pin 92 would reduce the total stroke tool 10 could apply to band 13, resulting in lower tensioning force. Due to the interconnection with the tension pin 78 through the link 106, the tension pin 78 will be similarly allowed to move farther into its elongated slot 76 toward the edge 210 for greater gripping strength, thus adjusting automatically for a longer stroke.

The pull up handle 116 is pivotally connected to the connection rod 32 by a pin 130 passing through holes 132 and 133. The pull up handle 116 is pivotally connected to the head receptacle 34 by a pin 134 through a hole 136 in the head 34 and a hole 138 in the handle 116 and is held in position by snap rings 135. The handle 116 may be provided with a pliant cover 140 for comfort of operation. A spring 142 is inserted into a receptacle 144 in the handle 116 and into the head receptacle 34 to bias the handle 116 in a direction indicated by an arrow 146.

A plurality of bolts 148 fit into holes 150 in the head receptacle 34 and are threadably received by the head 36 within holes 152 therein. Thus, the head 36 is secured within the head receptacle 34 by the bolts 148.

A cutoff handle 154 is pivotally attached to the head receptacle 34 by a pin 156, secured in place by a pair of snap rings 162, passing through holes 158 in the receptacle 34 and a hole 160 in the handle 154. A spring 164 is positioned between the handle 154 and the head receptacle 34 to bias the handle 154 in a direction indicated by an arrow 166. The handle 154 may also be provided with a pliant cover 168 for comfort of operation.

A pair of cutoff links 170 are pivotally attached to the handle 154 by a pin 172. The cutoff links 170 are pivotally attached at an end opposite the handle 154 to a cutoff arm 174 by a pin 176 which is held in place by snap rings 177. A pin 178 passes through the links 170 for interaction with the tension holding hook 104, as will be subsequently described in greater detail. The cutoff arm 174 is pivotally connected to a cutoff knife 180 by a pin 182 and to the head 36 by a pin 184. The cutoff knife 180 is slidably received within a receptacle 186 in the head 36 for cooperation with the cutoff blade 86 to sever the band 13, as will be subsequently described in greater detail.

The tension holding hook 104 has a hook 188 and a cam surface 190. The tension holding hook 104 is pivotally connected to the head 36 by a pin 192. A spring 194 is received by the tension holding hook 104 and a receptacle 196 in the tension transfer lever 44. The spring 194 biases the tension holding link 104 in a counterclockwise direction, as indicated by an arrow 198, about the pin 192.

Figures 3A, 3B:
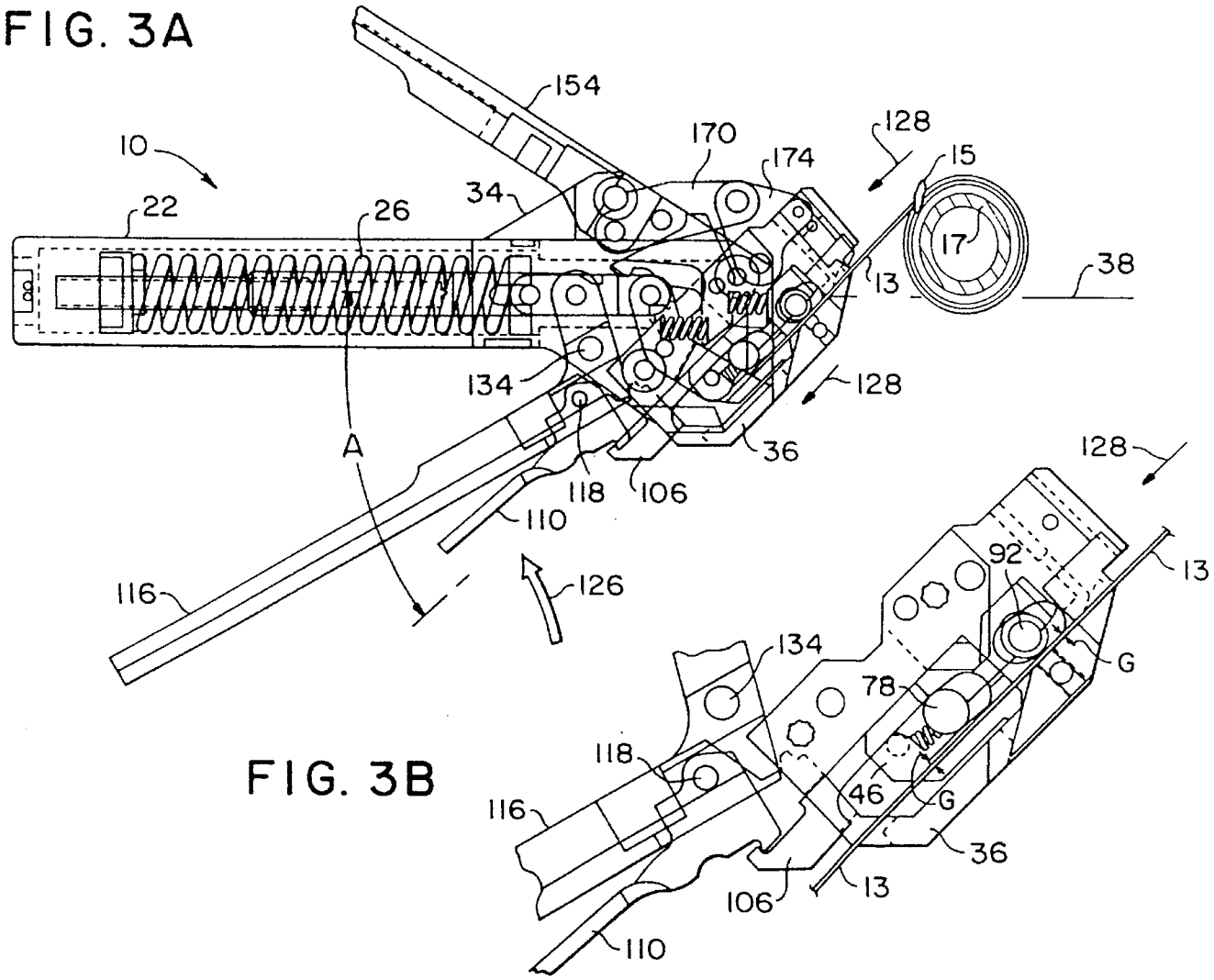
FIGS. 3A and B are cross-sectional views of the tool with a band clamp to be tensioned being inserted therein.

The operation of the tool 10 will now be discussed with reference to FIGS. 3 through 8. Referring first to FIGS. 3A and 3B, the insertion of a band clamp 12 into the tool 10 is illustrated. With the pull up handle 116 and the cutoff handle 154 in their spring biased positions, the tension hold/release hook 110 is grasped by an operator and moved in the direction 126. Movement of the hook 110 in the direction 126 causes the tension hold/release link 106 to move in the direction 128. Thus, the tension pin 78 and the tension holding pin 92 are moved in their respective holes against their spring bias to form gaps G therebetween and the bottom surface 85 of the tension block 46 and the cutoff blade 86 which are at least slightly greater than the thickness of the band 13. The gaps G thus formed allow the band 13 to be inserted in the direction 128 into the tool 10. Due to the angle A between the linear axis 38 of the tensioning means 24 and the linear axis 40, the band 13 is maintained straight without the necessity of bending thereof around internal parts of the tool 10. Thus, tensioning of the band 13 and insertion thereof into the tool 10 is relatively easier than in prior art devices.

Figure 4B:
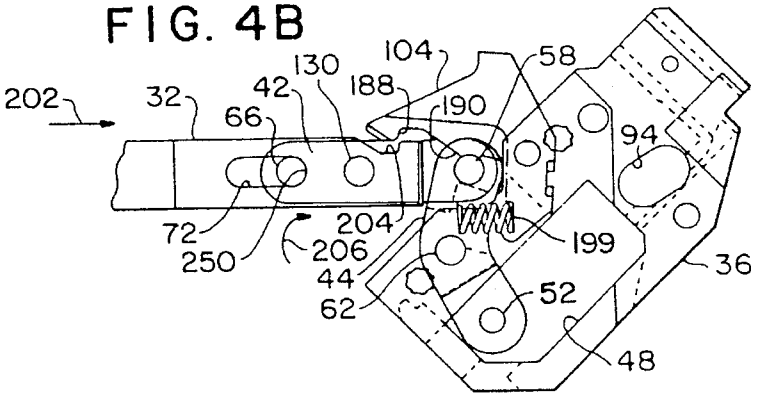
FIGS. 4A, B and C are cross-sectional views of the tool in an upstroke position.
Figure 4C:
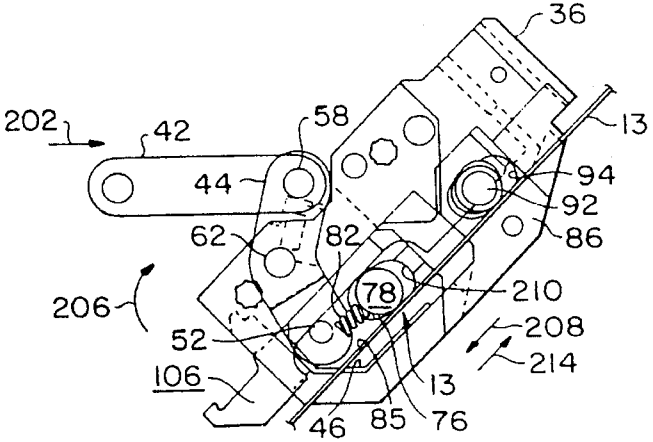
Figure 4A:
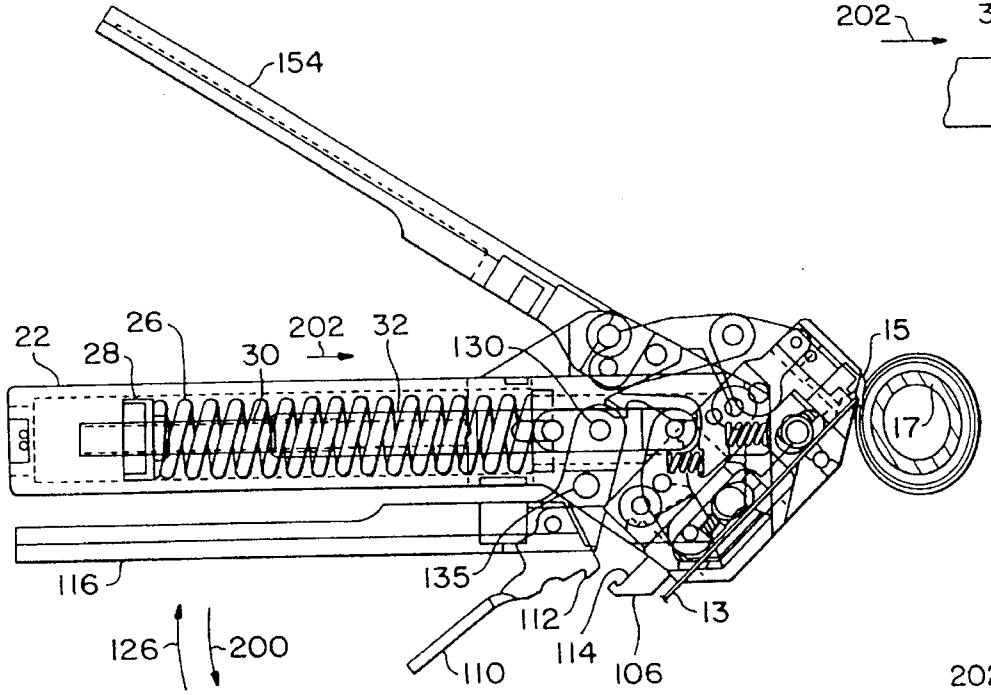

Referring to FIGS. 4A, 4B and 4C the tool 10 is shown in the tensioning mode. The pull up handle 116 is pulled back-and-forth as indicated by the arrow 126 and an arrow 200 between the position as shown in FIG. 4A and the position as shown in FIG. 3A. As the handle 116 is moved in the direction 126, the tension hold/release hook 110 is not engaged with the tension hold/release link 106.

As the handle 116 pivots about the pin 135, the connecting rod 32 is moved in a direction indicated by an arrow 202 as a result of the interconnection thereto by the pin 130. As can be seen in FIG. 4B, movement of the rod 32 similarly causes movement of the push links 42 in the direction 202. Movement of the links 42 in the direction 202 is caused by the pin 66 engaging a front edge 250 of the slot 72 in the connecting rod 32. The pin 66 is held against the edge 250 by the support plunger 68 which is in turn pushed in the direction 202 by the storing device 26. As long as the tension in the band 13 does not overcome the recompression of the device 26 the pin 66 is held against the edge 250. In other words, the assembly 24 acts as a solid rod until the band 13 reaches the predetermined tension.

Therefore, as the link moves in the direction 202 the tension transfer lever 44 is forced to pivot in a clockwise direction as indicated by an arrow 206 about the pin 62 as a result of the interconnection therebetween with the link 42 by pin 58. As the pin 58 moves in the direction 202 it slides along the cam surface 190 of the tension holding hook 104 against the bias of the spring 194 and the hook 188 thereof is held out of the slot 204 in the connecting rod 32. Thus, an operator knows that the band 13 has not been tensioned the desired amount and further cycling of the handle 116 is required.

Referring to FIG. 4C, as the link 42 moves in the direction 202, the transfer lever 44 pivots in the clockwise direction 206. Due to the interconnection between the lever 44 and the tension block 46 by the pin 52, the tension block 46 is moved in a direction indicated by an arrow 208. Movement of the tension block 46 in the direction 208 forces the tension pin 78 toward the edge 210 of the elongated slot 76 therein, and the band 13 is gripped between the pin 78 and the bottom surface 85 of the block 46. Thus as the handle 116 moves in the direction 126, the band 13 is moved in the direction 208 to increase the tension therein. As the band 13 is moved in the direction 208 by the pin 78 and the block 46, the pin 92 is moved toward the edge 212 of the elongated slot 94. Thus the band 13 is allowed to pass between the pin 92 and the cut-off blade 86.

When the handle 116 is moved in the direction 200, the block 46 is moved in a direction indicated by an arrow 214.

As the block 46 moves in the direction 214, tension in the band 13 causes the band 13 to also try to move in the direction 214. The tension in the band 13 and the bias of the spring 98 thus moves the pin 92 away from the edge 212 in the slot 94 and holds the band 13 from movement in the direction 214. Similarly, movement of the block 46 in the direction 214 causes the pin 78 to move against the bias of the spring 82 and away from the edge 210 in the slot 76, allowing the pin 78 to pass freely over the band 13. Therefore, the handle 116 is cycled in the direction 126 and 200 as described to gradually tension the band 13 around the shield 17.

It is an advantage of the tool 10 that the handle 116 and lever 44 is used rather than toggles, as are found in the prior art. The handle 116 and the lever 44 provide a mechanical advantage over toggles allowing fewer cycles of the handle 116 to move the band farther than in a corresponding toggle tool. Although not shown, it is to be understood that by varying the length of the lever 44 about the pin 62, various mechanical advantages may be achieved. Additionally, the use of the force storing device 26 such as a precompressed spring allows the tool 10 to be smoother, easier to operate and more accurate than prior devices.

Figure 5A:
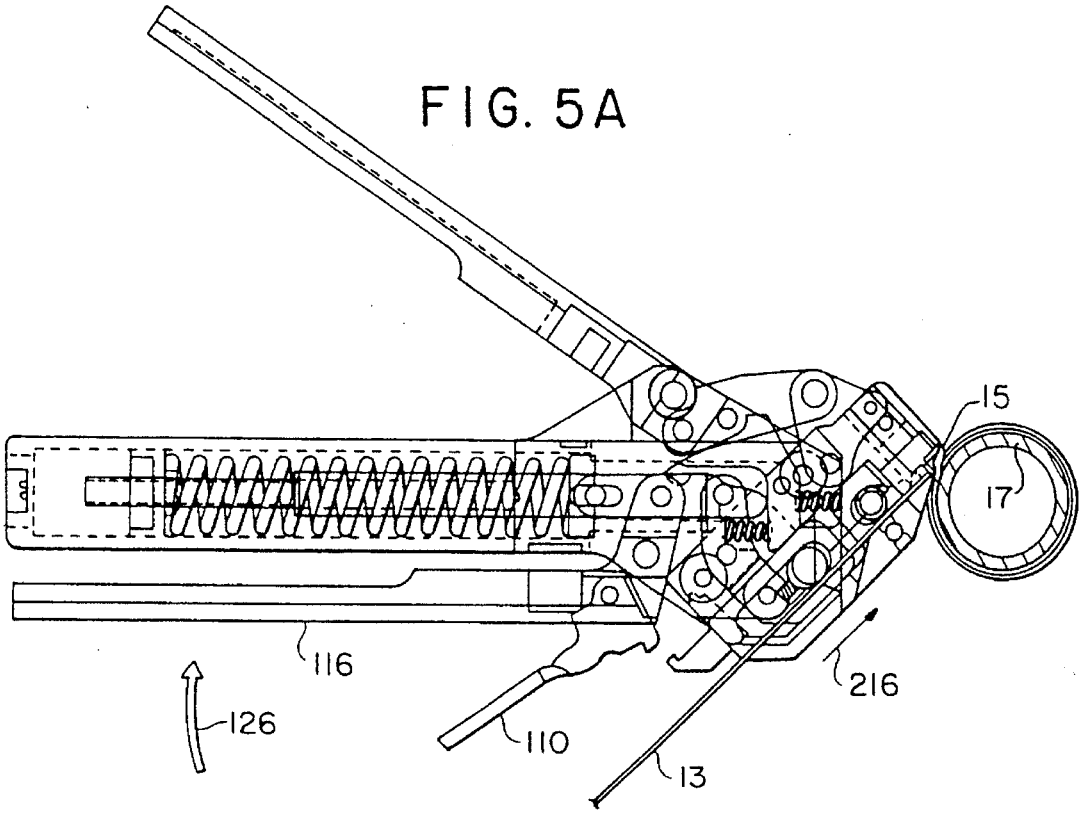
FIGS. 5A and B are cross-sectional views of the tool in the signal position.
Figure 5B:
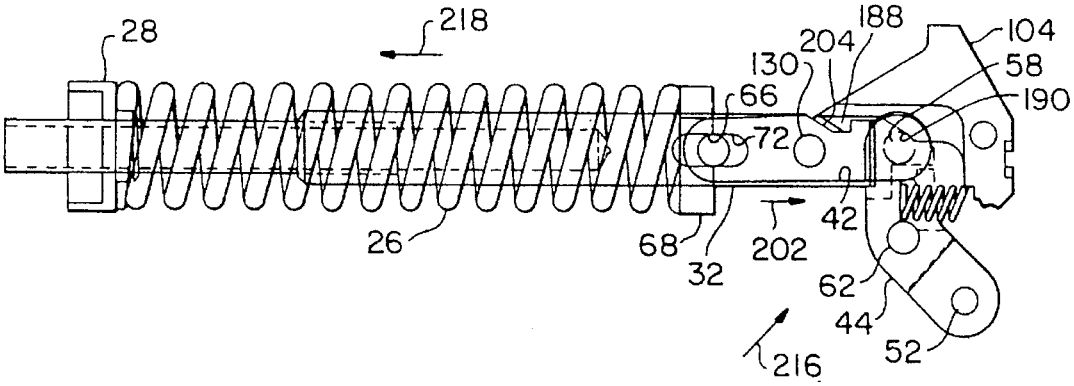

Referring to FIGS. 5A and 5B, the band 13 has been pulled to the desired tension within the tool 10. When the desired tension is reached, the handle 116 is locked in the position as shown in FIG. 5A. In the locked condition, the spring 142 (see FIG. 2A) is unable to return the handle 116 to the position shown in FIG. 3A, and the operator knows that the desired tension has been reached.

As best seen in FIG. 5B, when the tension in the band 13, as indicated an arrow 216, exceeds the recompression of the storing device 26, the device 26 further compresses in a direction indicated by an arrow 218. Thus the support plunger 68 and the pin 66 also move in the direction 218 as the connecting rod 32 moves in the direction 202. Since the pin 58 is also connected to the push links 42, the pin 58 does not move in the direction 202 and does not ride along the cam surface 190 of the tension holding hook 104. Thus the hook 188 thereon enters the slot 204 on the connecting rod 32 to lock the handle 116 in the position as shown in FIGS. 5A and 5B.

Figure 6A:
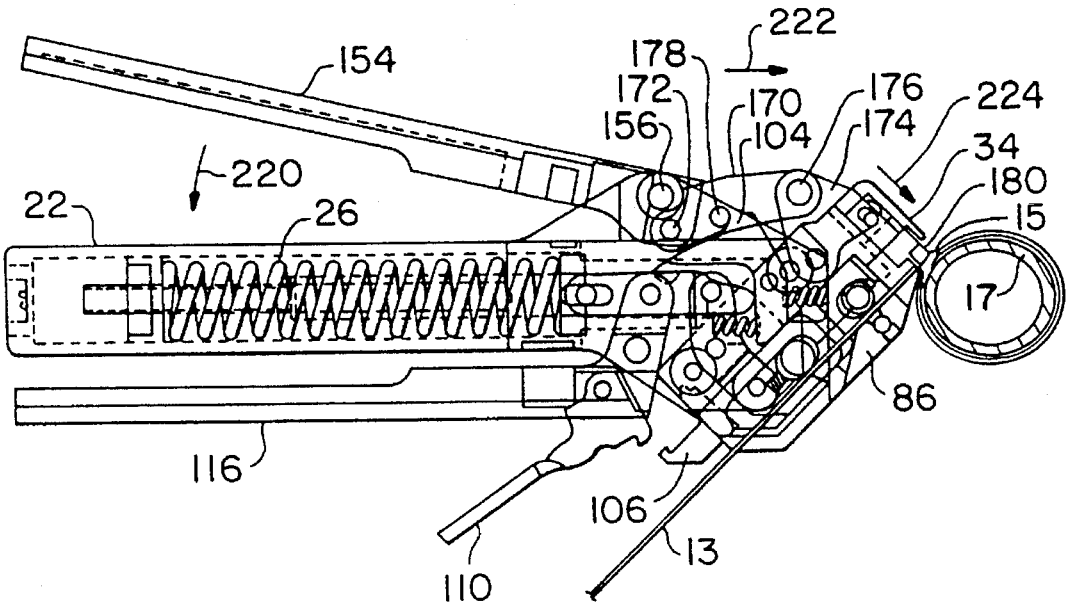
FIGS. 6A, B and C are side cross-sectional views of the cutting operation.
Figure 6B:
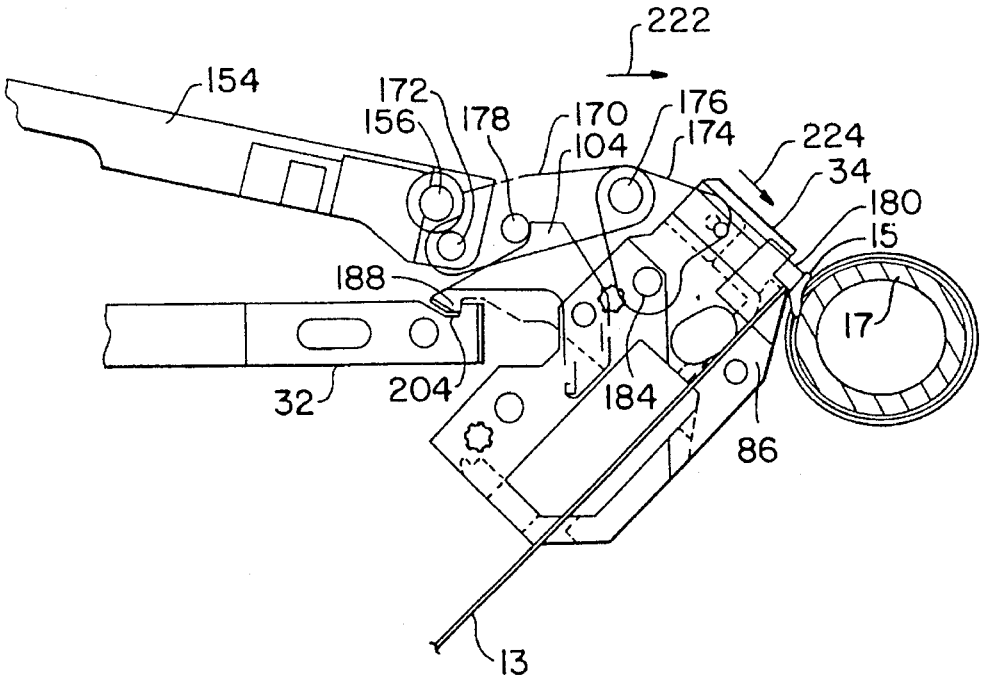
Figure 6C:
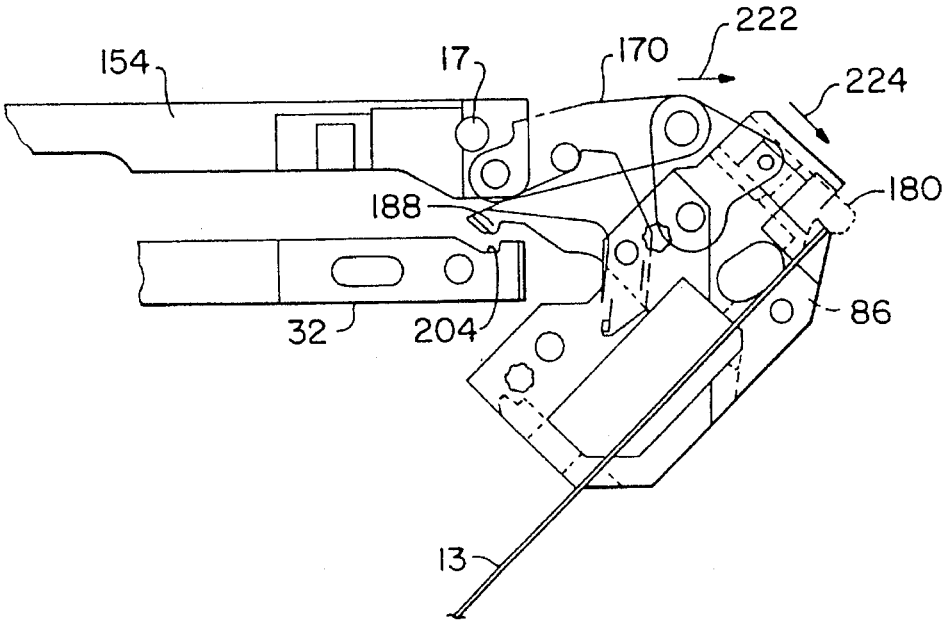

Referring to FIGS. 6A, 6B and 6C, the cut-off sequence is illustrated. Referring first to FIGS. 6A and 6B, the pull up handle 116 is in the uppermost locked position. The cut-off handle 154 pivots in a direction as indicated by an arrow 220 about pin 156 which moves the cut-off links 170 in a direction indicated by an arrow 222. Movement of the links 170 in the direction 222 causes the cut-off arm 174 to pivot clockwise about the pin 184. The clockwise rotation of the cut-off arm 174 moves the cut-off knife 180 in a direction indicated by an arrow 224. The cut-off knife 180 first contacts the buckle 15 and then bends and severs the band 13 therebetween and the cut-off blade 86, as will be subsequently described in greater detail. Simultaneously, the pin 178 contacts the tension holding hook 104 to push the hook 104 in the direction 222 and thus release the hook 188 from the slot 204 (as shown in FIG. 6C) which will allow the pull up handle 116 to return to the extended position as shown in FIG. 3A.

Figures 7A, 7B, 7C:
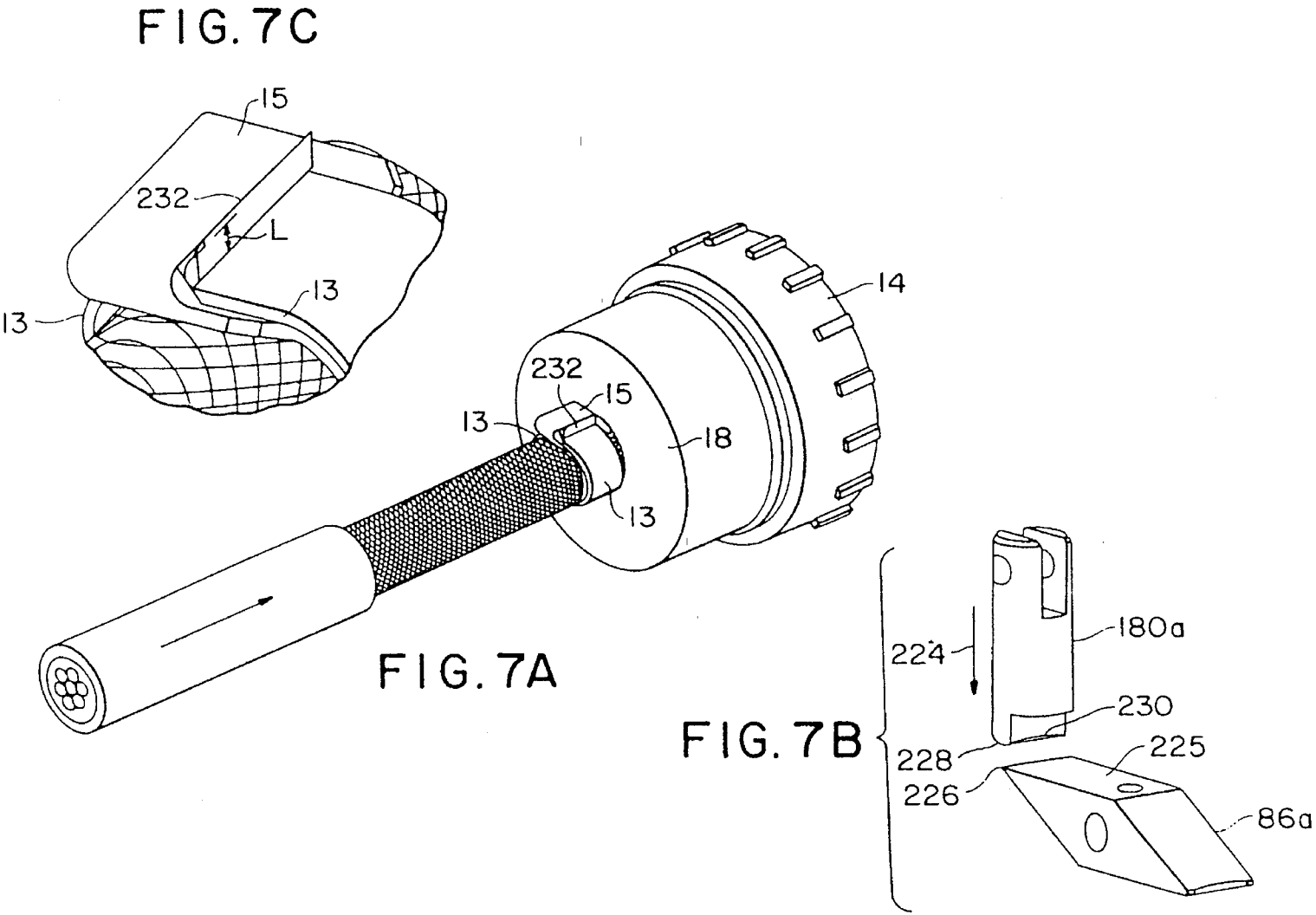
FIGS. 7A, B and C are isometric views of one embodiment of a locking tab and the hardware required for formation thereof.

Referring to FIGS. 7A and 7B, one embodiment of a cut-off arrangement is illustrated. Referring first to FIG. 7B, the cut-off blade 86 and the cut-off knife 180 are shown in perspective. The cut-off blade 86 which is reversible within the tool 10, provides a flat surface 225 for cooperation with the tension holding pin 92 to hold the band 13 therebetween. A cutting and bending edge 226 is provided for cooperation with the knife 180*a*.

As the knife 180*a* is pushed in the direction 224 by movement of the cut-off handle 154, a lower surface 228 thereof first contacts the buckle 15. Interaction between the lower surface 228, the buckle 15 and the upper surface 225 of the blade 86*a* causes the band 13 to be first bent and then severed. Due to an arcuate cutter 230 on the cut-off knife 180*a*, an arcuate tab 232 as shown in FIG. 7A is formed. The length L of the tab 232 is controlled by the thickness of the buckle 15 and the vertical location of the arcuate cutting edge 230. As the buckle 15 is pushed in the direction 224 by the knife 180*a*, the band 13 is bent by the buckle 15 before being severed by the arcuate cutter 230.

Figures 8A, 8B, 8C:
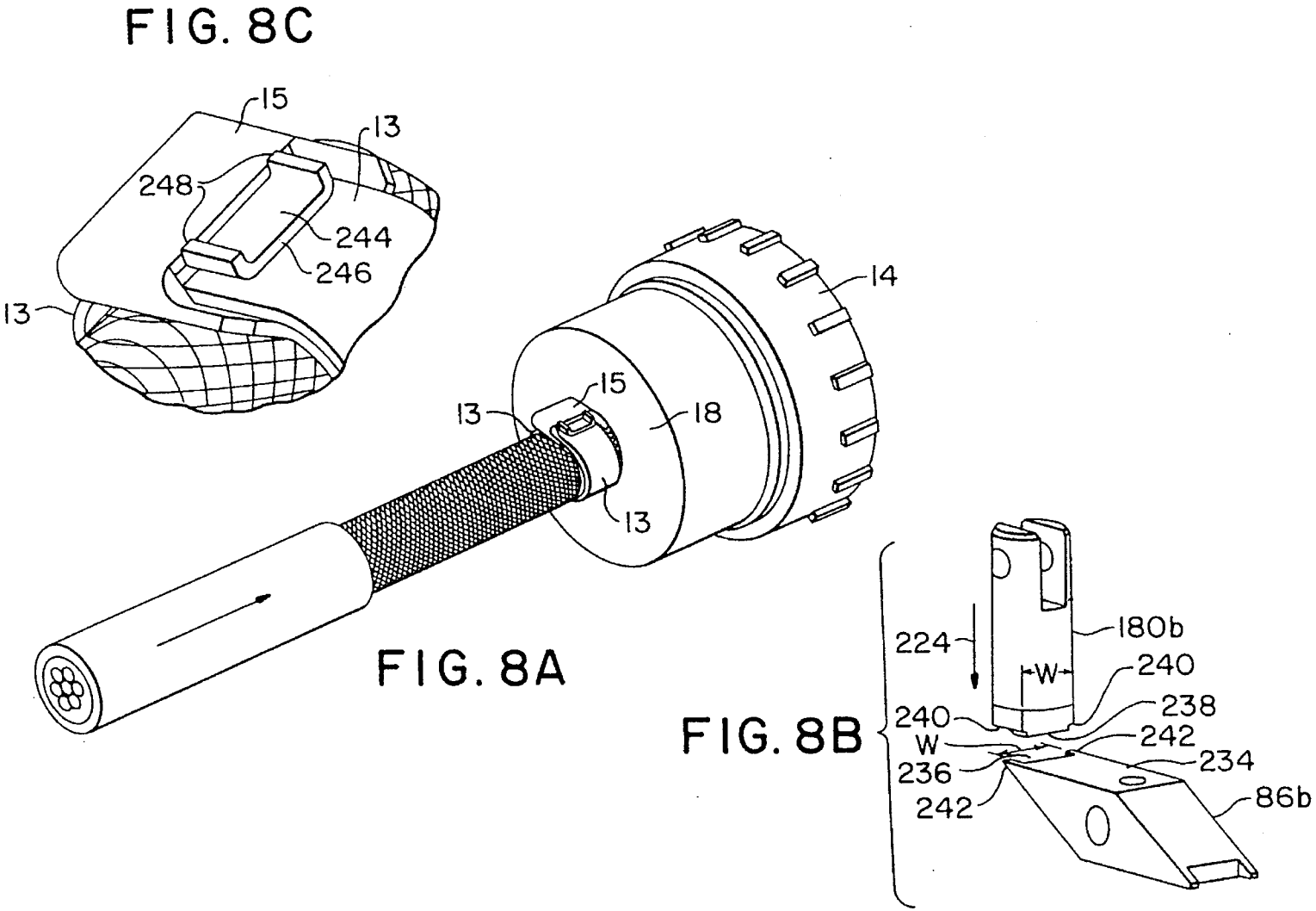
FIGS. 8A, B and C are isometric views of another embodiment of a locking tab and the hardware required for formation thereof.
Figure 9A:
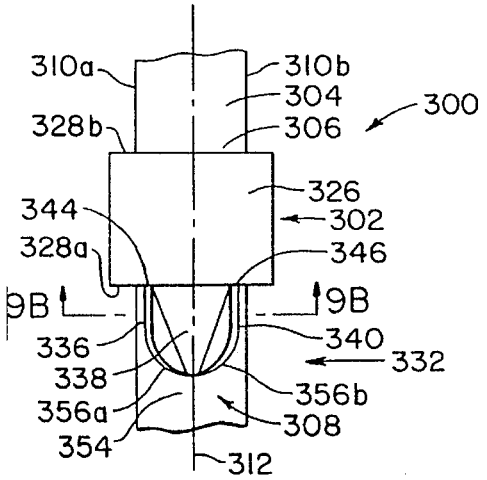
FIGS. 9A–9D are, respectively, top, cross-sectional end, side, and perspective views of one embodiment of a lock.
Figure 9C:
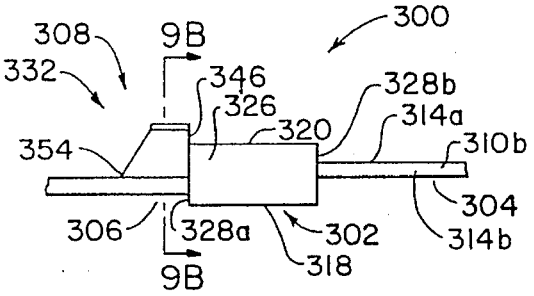
Figure 9B:
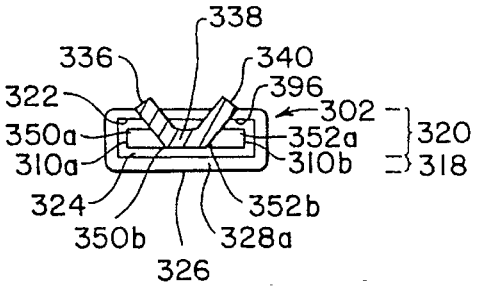
Figure 9D:
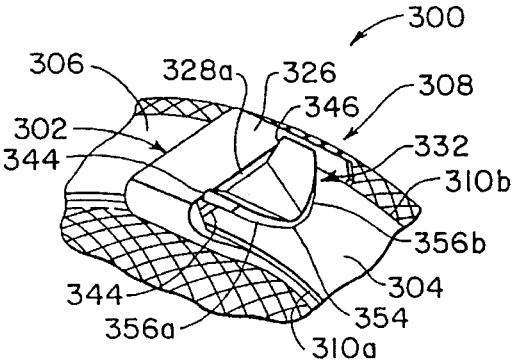
Figure 10A:
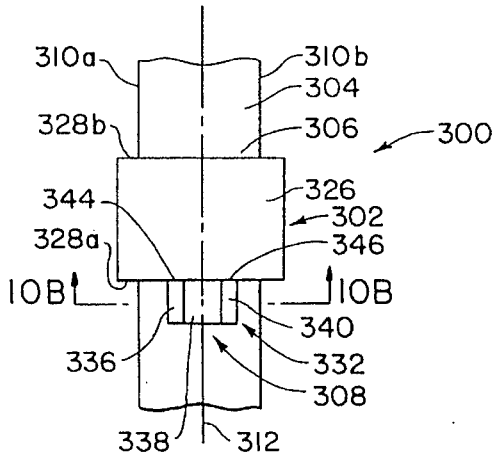
FIGS. 10A–10D are, respectively, top, cross-sectional end, side, and perspective views of another embodiment of a lock.
Figure 10C:
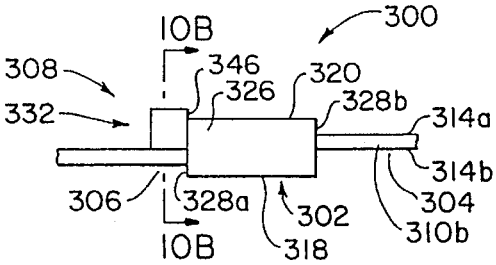
Figure 10B:
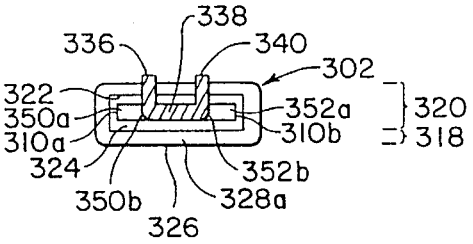
Figure 10D:
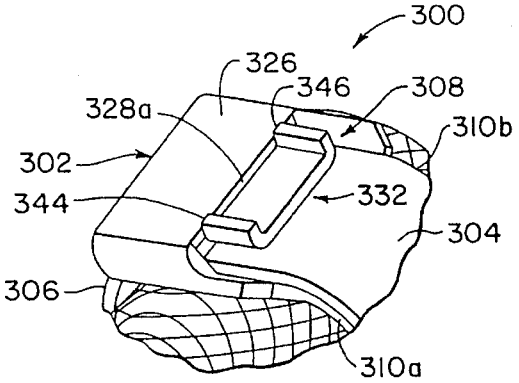
Figure 11A:
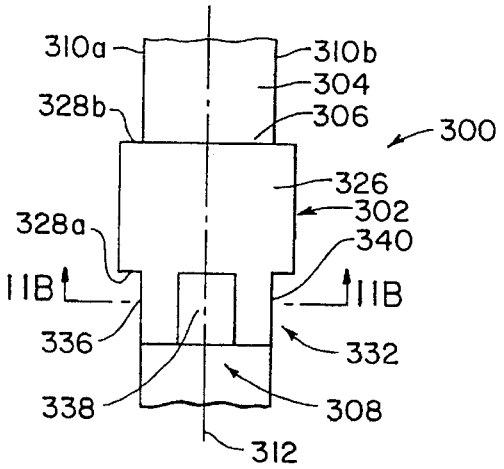
FIGS. 11A–11D are, respectively, top, cross-sectional end, side, and perspective views of another embodiment of a lock.
Figure 11C:
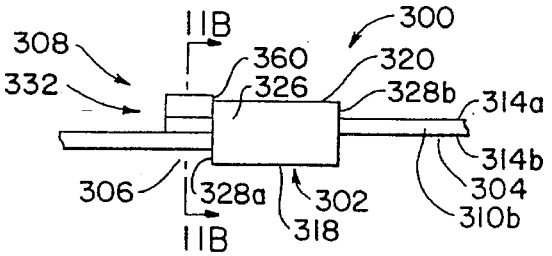
Figure 11B:
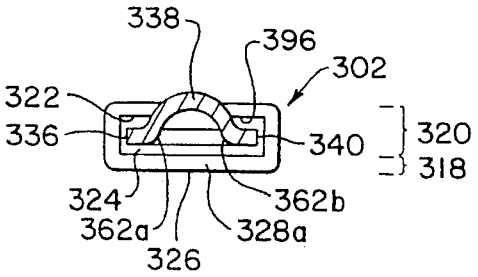
Figure 11D:
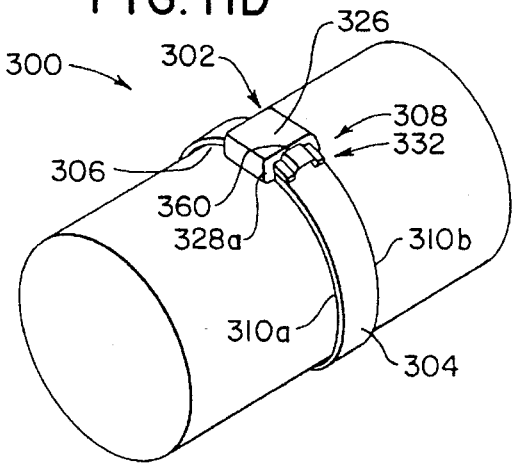
Figure 12A:
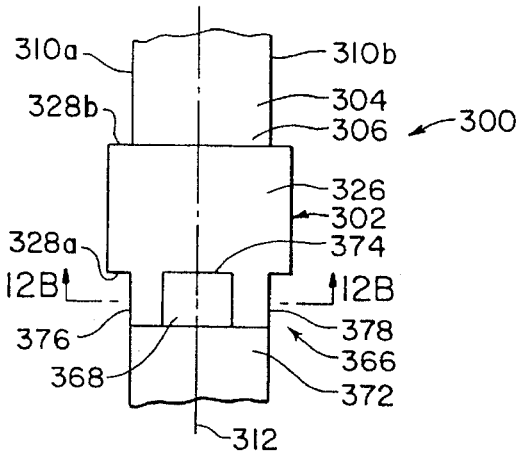
FIGS. 12A–12D are, respectively, top, cross-sectional end, side, and perspective views of another embodiment of a lock.
Figure 12C:
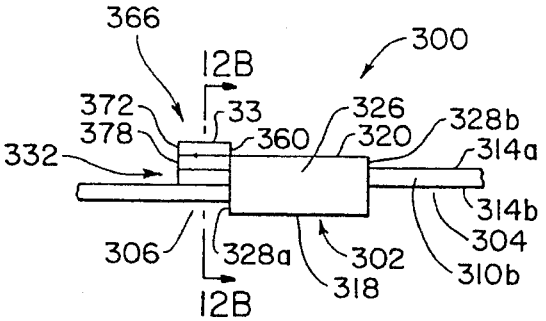
Figure 12B:
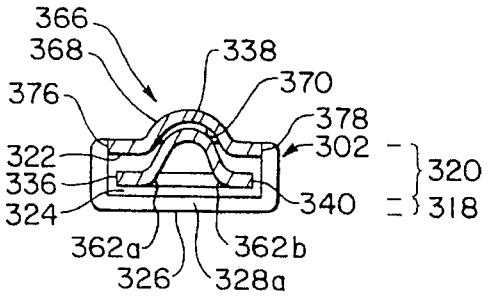
Figure 12D:
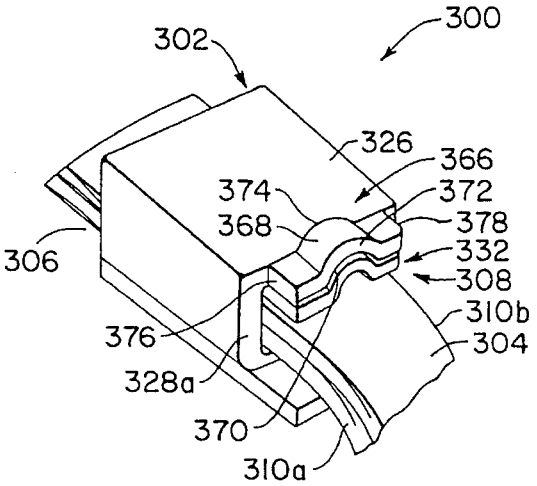
Figure 13C:
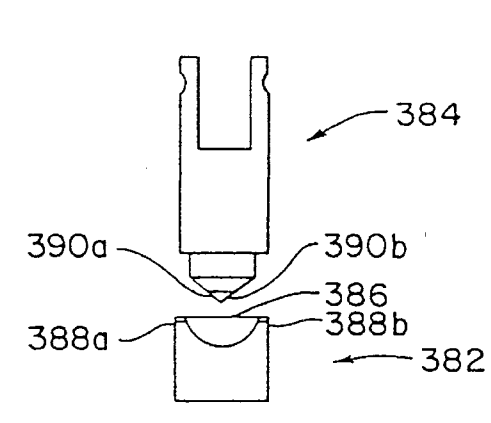
FIGS. 13A–13D are, respectively, side, bottom, front, and perspective views of a cut-off knife and cut-off blade used to form the lock illustrated in FIGS. 9A–9D.
Figure 13D:
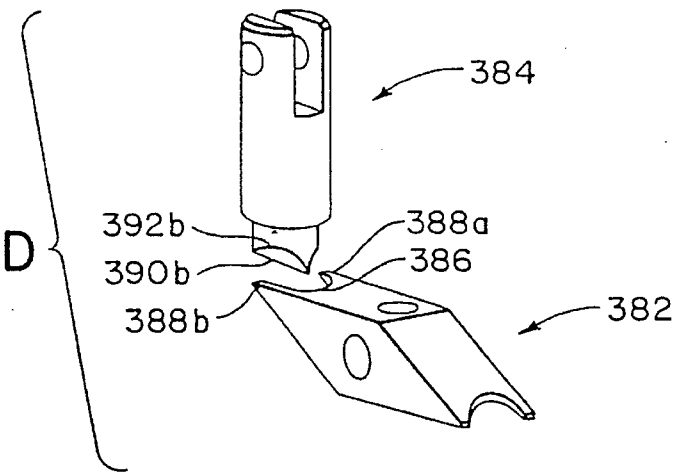
Figure 13A:
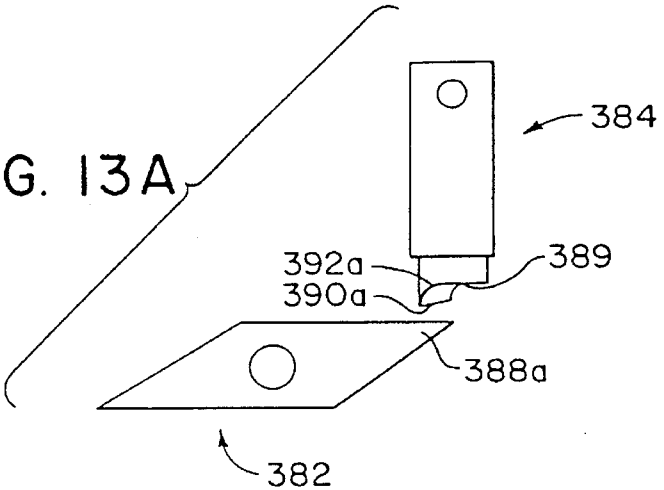
Figure 13B:
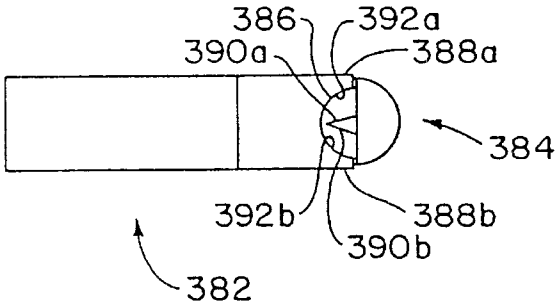
Figure 14C:
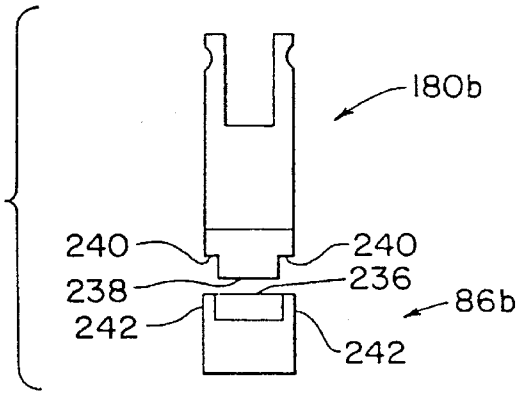
FIGS. 14A–14D are, respectively, side, bottom, front, and perspective views of a cut-off knife and cut-off blade used to form the lock illustrated in FIGS. 10A–10D.
Figure 14D:
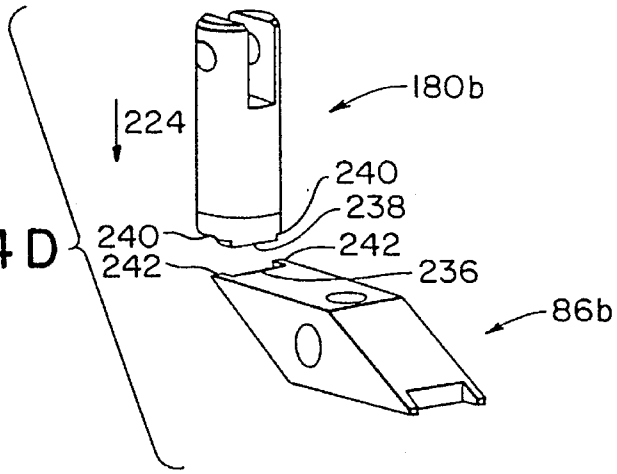
Figure 14A:
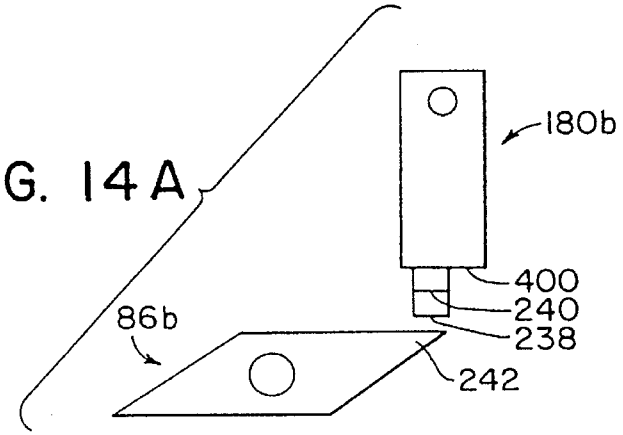
Figure 14B:
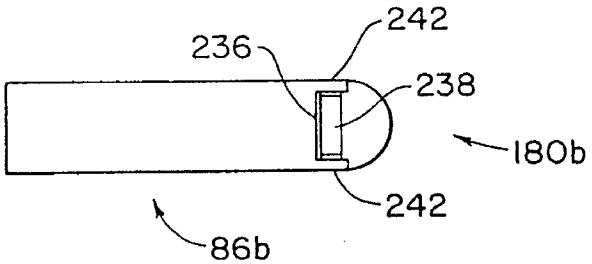
Figure 15C:
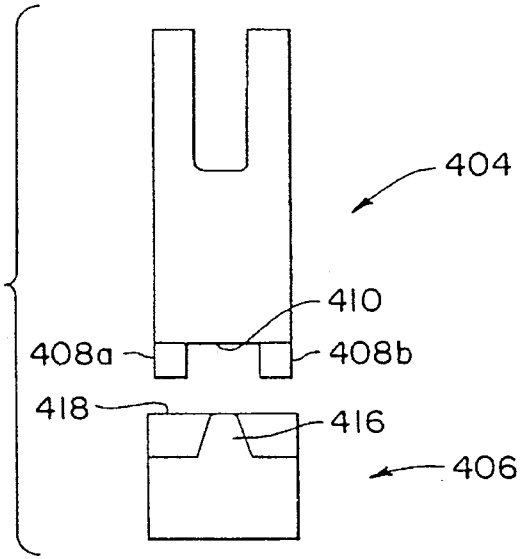
FIGS. 15A–15D are, respectively, side, bottom, front, and perspective views of a cut-off knife and cut-off blade used to form the lock illustrated in FIGS. 11A–11D and 12A–12D.
Figure 15D:
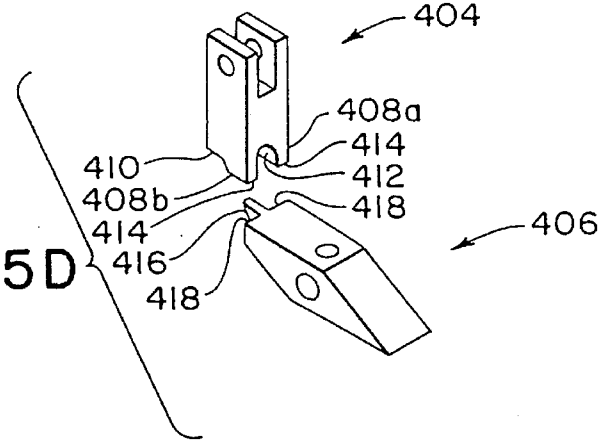
Figure 15A:
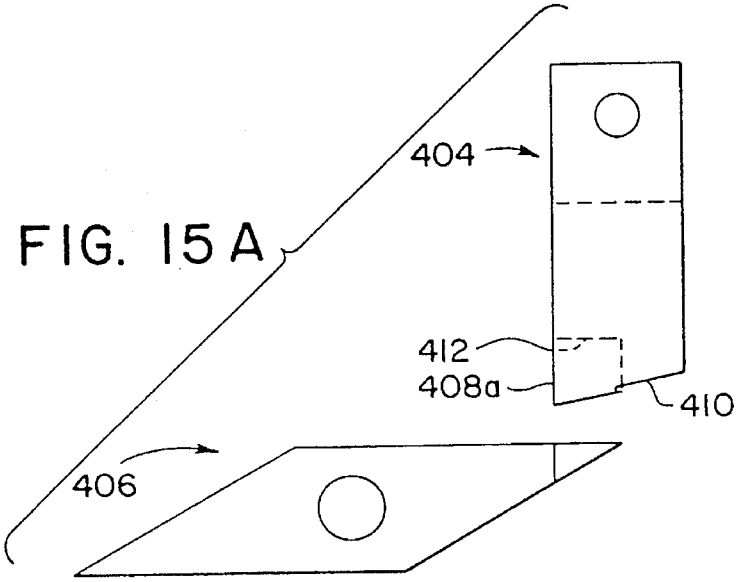
Figure 15B:
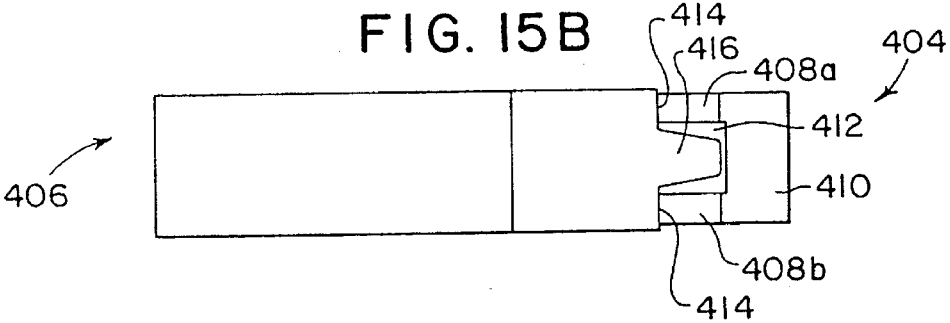

Referring to FIGS. 8A and 8B, an alternative cutting arrangement is illustrated. Referring first to FIG. 8B, a cut-off blade 86*b* and cut-off knife 180*b* are shown. The cut-off blade 86*b* has flat surface 234 and bending/cutting edge 236. The blade 86*b* has stepped bottom surface 238 having width W matching width w of the bending/cutting edge 236. Thus as the knife 180*b* moves in the direction 224, the lower surface 238 comes into contact with the band 13 beyond the buckle 15. The band. 13 is forced into the width w of the blade 86*b* by the bottom surface 238. When the shoulders 240 of the knife 180*b* come into contact with the extensions 242 of the blade 86*b*, the band 13 has been bent and severed into tab 244 as shown in FIG. 8A. Thus the tab 244 is formed with straight cut-off edge 246 and pair of retention ears 248. The retention ears 248 help secure the band 13 to the buckle 15 to prevent loss of tension therein.

Since it is important to the convenient use of the tool 10 to be able to tension the clamp 12 proximate the couple 14, the width of the tool 10 has been designed to be as close to the width of the band 13 as possible. Thus it is possible to place the tool 10 against the flange 18 and have the clamp 12 installed with minimum mount of space therebetween. Similarly, the tool 10 has been, designed for ease of operation by using the lever 447 rather than toggles as is found in the prior art. Finally, the angular relationship between the tensioning assembly and the head 36 provides a tool that is easy to load and that applies, more of the work force to tensioning the band 13 than in previous devices.

FIGS. 9–12 illustrate various embodiments of a lock for use with band clamp in which the lock provides improved strength characteristics relative to known locks in which the lock is formed by bending the band portion of the band clamp to create a locking surface that engages an exterior surface of a buckle portion of the band clamp.

In order to describe the lock of the present invention, it is believed to be useful to first describe the band clamp with which the lock is employed. With reference to FIGS. 9–12, the band clamp 300 includes a buckle 302 and band 304 with a first end 306 that is operatively attached to the buckle 302 and a second end 308 that can be wrapped about an object and then engaged to the buckle 302. The band 304 is further defined by a first lateral edge 310*a* that is substantially parallel to a second lateral edge 310*b*. A longitudinal axis 312 extends from the first end 306 to the second end 308 and is substantially perpendicular to line extending from a first point on the first lateral edge 310*a* to second point on the second lateral edge 310*b* that is the same distance from the first end 306 or the second end 308 as the first point. The band 304 further includes first face 314*a* that is substantially parallel to a second face 314*b*. The band 304 is made of a material that can be wrapped about an object and then bent, deformed or otherwise processed to lock the band 304 to the buckle 302. Typically, the band 304 is made from a metal material, such as steel or aluminum. However, other materials, such as plastic, can also be used.

The buckle 302 can be generally described as an open-ended sleeve-like structure with a lower member 318 that is positioned substantially adjacent to the object about which the band 304 is wrapped and an upper member 320 that is separated from the object of interest by the lower member 318. The lower member 318 and the upper member 320 define an interior surface 322 that, in turn, defines passageway 324 for receiving the band 304 after it has been wrapped about an object. The lower member 318 and the upper member 320 also define an exterior surface that includes an exterior side surface 326, first exterior end surface 328*a*, and second exterior end surface 328*b*. The buckle 302, like the band 304, is typically made of metal material, such as steel or aluminum, but other materials, such as plastic, can also be employed.

Having described the band clamp 300, the lock of the present invention is now described with reference to FIGS. 9–12. Characteristic of each embodiment of the lock is that a lateral cross-section of locking surface 332 that is established in portion of the second end 308 of the band 304 that emerges from the buckle 302 after the band 304 has been passed through the passageway 324 is that first point 336 on the first lateral edge 310*a* is different distance from the lower member 318 of the buckle 302 than an intermediate point 338 on the band 304 that is located in between the first point 336 and second point 340 on the second lateral edge 310*b*. The locking surface 332 engages the first exterior end surface 328*a* of the buckle 302 to prevent the band 304 from being pulled back through the passageway 324 of the buckle 302 as well as exhibits improved strength characteristics relative to known band clamp locks in which the band is bent, deformed, or otherwise processed to create a locking surface that engages the exterior of buckle.

FIGS. 9A–9D and 10A–10D illustrate two embodiments of the lock of the present invention. In these embodiments of the lock, the lateral cross-section of the locking surface 332 has a first point 336 on the first lateral edge 310*a* which is greater distance from the lower member 318 of the buckle 302 than the intermediate point 338 on the band 304 that is located in between the first point 336 and the second point 340 on the second lateral edge 310*b*. These embodiments of the lock can be further characterized in that the second point 340 on the second lateral edge 310*b* is a greater distance from the lower member 318 of the buckle 302 than the intermediate point 338 on the band 304. Further, the distance of the first point 336 on the first lateral edge 310*a* to the lower member 318 of the buckle 302 and the distance of the second point 340 on the second lateral edge 310*b* to the lower member 318 of the buckle 302 are substantially equal.

Further, in these embodiments of the lock, the locking surface 332 comprises a first inner edge 344 and a second inner edge 346 which are formed by cutting portions of the band that emerge from the buckle 302 after the band 304 has been passed through the passageway 324. Particularly, the first inner edge 344 is a surface intermediate to the first face 314*a* and the second face 314*b* and is formed by cutting the band 304 traverse to the longitudinal axis 312 from a first cutting point 350*a* on the first lateral edge 310*a* to a first intermediate cutting point 350*b*. The second inner edge 346 is a surface intermediate to the first face 314*a* and second face 314*b* and is formed by cutting the band 304 traverse to the longitudinal axis 312 from a second cutting point 352*a* on the second lateral edge 310*b*, which is substantially opposite to the first cutting point 350*a*, to a second intermediate cutting point 352*b*. The locking surface 332 is formed by bending, deforming or otherwise processing the first lateral edge 310*a* and second lateral edge 310*b*. The lock is established by engaging the first inner edge 344 and the second inner edge 346 of the locking surface 332 and the first exterior end surface 328*a* of the buckle 302.

Referring to FIGS. 9A–9D, this embodiment of the lock is further characterized by the lateral cross-section of the locking surface 332 being substantially V-shaped. It is a further characteristic of this embodiment of the lock that the band 304 has a second end 308 which comprises a point 354 where a first angled edge 356*a* and a second angled edge 356*b* merge. Particularly, when the first lateral edge 310*a* and second lateral edge 310*b* are being bent, deformed or otherwise processed to form the locking surface 332, the second end 308 of the band 304 is cut inwardly at an angle from the first lateral edge 310*a* to form first inward angled edge 356*a* and from the second lateral edge 310*b* to form a second inward angled edge 356*b*. The first angled edge 356*a* and the second angled edge 356*b* of the band 304 beginning where the first lateral edge 310*a* and second lateral edge 310*b* end, respectively. Formed this way, the force required to sever the excess portion of the second end 308 of the band 304 is substantially reduced and as result can be readily formed by a hand banding tool as well as a powered banding tool.

Referring to FIGS. 10A–10D, this embodiment of the lock is further characterized by the lateral cross-section of the locking surface 332 being substantially U-shaped. Consequently, the locking surface 332 is established by bending the first and second lateral edges 310*a*, 310*b* substantially parallel to the longitudinal axis 312. To ruin this embodiment of the lock would require the first lateral edge 310*a* and the second lateral edge 310*b* to be defeated long their entire length. The consequence being that this embodiment of lock, in addition to exhibiting the improved strength characteristics shown by the various embodiments of the present invention, also has generally long lasting qualities.

FIGS. 11A–11D and 12A–12D illustrate two embodiments of the lock of the present invention. In these embodiments of the lock, the lateral cross-section of the locking surface 332 is such that the intermediate point 338 that is located in between the first point 336 on the first lateral edge 310*a* and the second point 340 on the second lateral edge 310*b* is a greater distance from the lower member 318 of the buckle 302 than the first point 336 on the first lateral edge 310*a* . Further, the intermediate point 338 on the band 304 is a greater distance from the lower member 318 of the buckle 302 than the second point 340 on the second lateral edge 310*b*. In addition, the locking surface 332 is further characterized by the distance of the first point 336 on the first lateral edge 310*a* to the lower member 318 of the buckle 302 and the distance of the second point 340 on the second lateral edge 310*b* to the lower member 318 of the buckle 302 being substantially equal. Further, the locking surface is established by bending the first and second lateral edges 310*a*, 310*b* substantially parallel to the longitudinal axis 312 of the band 304.

Further, in these embodiments of the lock, the locking surface 332 comprises an intermediate edge 360 which is formed by cutting an intermediate portion 334 of the band 304 that emerges from the buckle 302 after the band 304 has been passed through the passageway 324. Particularly, the intermediate edge 360 is a surface intermediate to the first face 314*a* and the second face 314*b* of the band 304 and is formed by cutting the band 304 traverse to the longitudinal axis 312 from first internal cutting point 362*a* to a second internal cutting point 362*b*, which is substantially opposite to the first internal cutting point 362*a* relative to the longitudinal axis 312. The locking surface 332 is formed by bending, deforming or otherwise processing the intermediate edge 360. The lock is established by engaging the intermediate edge 360 and the first exterior end surface 328*a* of the buckle 302.

These embodiments of the lock can be further characterized by the lateral cross-section of the locking surface 332 being substantially Ω-shaped. Further, the intermediate edge 360 is substantially even with upper member 320 of the buckle 302. In addition to exhibiting strength characteristics, these embodiments are formed in such a way to reduce the probability that the integrity of the lock will be compromised. Particularly, in these embodiments of the lock, the exposed edges are reduced to reduce the chances that the lock will defeated because of snagging. An additional advantage of these embodiments of the lock is that, due to the surface in between the first and second lateral edges 310*a*, 310*b* being displaced relative to the lower member 318 of the buckle 302 rather than the first and second lateral edges 310*a*, 310*b*, it allows a banding tool to be designed which can be used to form the lock for various band and buckle widths.

With reference to FIGS. 12A–12D, in this embodiment of the lock, the exterior surface of the buckle 302 that engages the locking surface 334 further comprises lock cover 366 to protect the locking surface 334 against tampering. The lock cover 366 comprises cover exterior surface 368, cover interior surface 370, first cover end surface 372 and a second cover end surface 374, a first cover side surface 376, and a second cover side surface 378. Particularly, the lock cover 366 extends from the upper member 320 and over the portion of the band 2104 that emerges from the buckle 302 after the band 304 has been passed through the passageway 324. The lateral cross-section of the lock cover 366 is substantially similar to the lateral cross-section of the locking surface 332 being covered. In this embodiment of the lock, the lateral cross-section of the cover exterior surface 368 is substantially Ω-shaped.

In addition to providing protection for the lock, the lock cover 366 provides reference point for the banding tool that is used to form the lock. Particularly, when the locking surface 332 is formed, the intermediate edge 360 of the locking surface 334 conforms with the cover interior surface 370 of the lock cover 366. The lock is established by engaging the intermediate edge 360 of the locking surface 334 and the portion of the first exterior end surface 328*a* of the buckle 302 which is left exposed by the lock cover 366.

Having described the various embodiments of the lock of the present invention, the method of forming the various embodiments of the lock illustrated in FIGS. 9–12 and the tools for forming these locks will now be described. It is a characteristic of each embodiment of the lock that the locking surface 332 is established by shaping the portion of the second end 308 of the band 304 that emerges from the buckle 302 after being passed through the passageway 324, so that if the locking surface 332 is viewed in lateral cross-section, the first point 336 on the first lateral edge 310*a* is a different distance from the lower member 318 of the buckle 302 than the intermediate point 338 located in between the first point 336 and the second point 340 on the second lateral edge 310*b*. The locking surface 332 can then engage the first exterior end surface 328 of the buckle 302 to prevent the band 304 from being pulled back through the passageway 324 of the buckle 302 as well as exhibits improved strength characteristics relative to known band clamp locks in which the band is shaped to create a locking surface that engages the exterior of the buckle.

As discussed earlier, FIGS. 9A–9D and 10A–10D illustrate two embodiments of the lock of the present invention. In these embodiments of the lock, the locking surface 332 is formed by shaping the portion of the second end 308 of the band 304 that emerges from the buckle 302 after the band 304 has passed through the passageway 324 so that if the locking surface 332 is viewed in lateral cross-section, the first point 336 on the first lateral edge 310*a* is a greater distance from the lower member 318 of the buckle 302 than the intermediate point 338 on the band 304; the second point 340 on the second lateral edge 310*b* is also greater distance from the lower member 318 of the buckle 302 than the intermediate point 338; and the distances between the first point 336 and the lower member 318 and between the second point 340 and the lower member 318 of the buckle 302 are substantially equal.

Referring to FIGS. 9A–9D, this embodiment of the lock is further characterized by shaping the portion of the second end 308 of the band 304 that emerges from the buckle 302 so that the lateral cross-section of the locking surface 332 is substantially V-shaped in accordance with the method previously discussed. The forming of the locking surface 332 also includes cutting the second end 308 of the band 304 from the first cutting point 350*a* to the first intermediate cutting point 350*b* and from the second cutting point 352*a* to the second intermediate cutting point 352*b* to form first cut and a second cut respectively, in the band 304. These cuts facilitate bending the band 304 to establish the aforementioned V-shape as well as establish the first inner edge 344 and the second inner edge 346 that contact the first exterior end surface 328 of the buckle 302. Additionally, the second end 308 of the band 304 is cut to trim the excess portion the second end 308. Specifically, the second end 308 is cut at an angle or long a curve from the first lateral edge 310*a* to form the first angled edge 356*a* and from the second lateral edge 310*b* to form the second angled edge 356*b*. By trimming the second end 308 in this way, a tool can be designed that permits the cut or cuts to be made over defined period of time rather than simultaneously. As a result, less force per unit of time is needed to make the cut or cuts thereby allowing implementation in a hand tool as well as a powered tool.

One way to form the embodiment of the lock referred to in FIGS. 9A–9D is to use the banding tool previously described with a V-blade 382 and a V-knife 384. The V-blade 382 includes a curved edge 386, first leg 388*a*, a second leg 388*b*, and buckle contact surface 389 that cooperate with the V-knife 384 to form the locking surface 332. Likewise, the V-knife 384 includes first angled straight edge 390*a*, second angled straight edge 390*b*, first curved edge 392*a*, and second curved edge 392*b* for cooperating with the edges and surfaces of the blade 382 to produce the locking surface 332 and to sever the excess portion of the band 304.

With the V-blade 382 and V-knife 384 installed in the tool and the second end 308 of the band 304 being appropriately tensioned by the tool, formation of the locking surface 332 commences with the V-knife 384 being displaced toward the V-blade 382 by the movement of the cut-off handle 154. As the V-knife is displaced the buckle contact surface 389 comes into contact with the upper member 320 of the buckle 302. Likewise, the first angled straight edge 390*a* and the second angled straight edge 390*b* come into contact with the first face 314*a* of the band 304. With contact established, the V-knife 382 is now further displaced toward the V-blade 384 to establish the locking surface 332 and to sever the excess portion of the second end 308 of the band. Specifically, further displacement of the V-knife 384 results in the first and second angled straight edges 390*a*, 390*b* of the V-knife 384 cooperating with the first and second legs 388*a*, 388*b* of the V-blade 382 to bend the first lateral edge 310*a* and second lateral edge 310*b* of the band 304 way from the lower member 318 of the buckle 302 in the characteristic V-shape. Also as result, the band 304 immediately adjacent to the first exterior end surface 328*a* of the buckle 302 is cut from the first cutting point 350*a* on the first lateral edge 310*a* to the first intermediate cutting point 350*b* and from the second cutting point 352*a* on the second lateral edge 310*b* to the second intermediate cutting point 352*b* to form the first inner edge 344 and the second inner edge 346 of the locking surface 332, respectively. These cuts are caused by the bending of the band 304 forcing the first face 314*a* of the band 302 into contact with the portion of the first exterior end surface 328*a* associated with the upper member 320 of the buckle 302. The surface is hereinafter referred to as the band cutting edge 396. The lock is now formed by the engagement of the locking surface 332 to the buckle 302 and, more specifically, by the engagement between the first inner edge 344 and the second inner edge 346 of the locking surface 332 with the first exterior end surface 328*a* of the buckle 302.

After formation of the locking surface 332, the band 304 is cut to form first angled edge 356*a* and second angled edge 356*b*, which terminate into point 354, by the opposition of first and second curved edges 392*a*, 392*b* of the V-knife 384 against the curved edge 386 of the V-blade 384. Due to the curve of the first and second curved edges 392*a*, 392*b*, the cuts required to form the first and second angled edges occur over a period of time rather than simultaneously. Consequently, the force required to sever the excess portion of the second end 308 of the band 304 is substantially reduced and as a result can be readily accomplished with the hand banding tool as well as a powered banding tool. Further, the lock is established while voiding release of tension in the band and relative rotation between the band and the clamped object together with the thinning that is associated with this rotation.

Referring to FIGS. 10A–10D, this embodiment of the lock is further characterized by shaping the portion of the second end 308 of the band 304 that emerges from the buckle 302 so that the lateral cross-section of the locking surface 332 is substantially U-shaped in accordance with the method previously discussed. The forming or shaping of the locking surface 332 also includes cutting the band 304 from the first cutting point 350*a* to the first intermediate cutting point 350*b* and from the second cutting point 352*a* to the second intermediate cutting point 352*b* to form first cut and a second cut, respectively, in the band 304 that facilitate the bending of the first and second lateral edge 310*a*, 310*b* the band 304 substantially parallel to the longitudinal axis 312 to achieve the U-shape characteristic of this particular embodiment of the lock. Further, the cuts establish the first inner edge 344 and second inner edge 346 that engage the first exterior end surface 328 of the buckle 302. Also, in conjunction with forming the locking surface 332, the second end 308 of the band 304 is trimmed.

One way to form the embodiment of the lock referred to in FIGS. 10A–10D is to use the banding tool with the cut-off blade 86*b* and cut-off knife 180*b* previously described. To reiterate, as the cut-off knife 180*b* is pushed in the direction 224 by the movement of the cut-off handle 154, a buckle contact surface 400 of the cut-off knife 180*b* contacts the upper member 320 of the buckle 302. Further, the lower surface 238 of the cut-off knife 180*b* comes into contact with the first face 314*a* of the band 304. After contact is established, the cut-off knife 180*b* is now further displaced towards the cut-off blade 86*b* to form the locking surface 332 and to trim the excess portion of the second end 308 of the band 304. Specifically, further displacement of the cut-off knife 180*b* results in the lower surface 238 cooperating with the extensions 242 of the cut-off blade 86*b* to bend the first lateral edge 310*a* and second lateral edge 310*b* of the band 304 away from the lower member 318 of the buckle 302 to form the characteristic U-shape of the lock. Also, as a result, the band 304 immediately adjacent to the first exterior end surface 328*a* of the buckle 302 is cut from the first cutting point 350*a* on the first lateral edge 310*a* to the first intermediate cutting point 350*b* and from the second cutting point 352*a* on the second lateral edge 310*b* to the second intermediate cutting point 352*b* to form the first inner edge 344 and the second inner edge 346 of the locking surface 332, respectively. These cuts are caused by the bending of the portion of the band 304 forcing the first face 314*a* of the band 304 into contact with the band cutting edge 396. The lock is now formed by the engagement of the locking surface 332 to the buckle 302 and, more specifically by the engagement of the first inner edge 334 and the second inner edge 346 of the locking surface 332 with the first exterior end surface 328*a* of the buckle 302. It should also be noted that the lock is established while substantially avoiding the release of tension in the band and relative rotation of the band and the clamped object together with the thinning resulting from rotation.

FIGS. 11A–11D and 12A–12D illustrate two embodiments of the lock of the present invention. In these embodiments of the lock, the locking surface 332 is formed by shaping the portion of the second end 308 of the band 304 that emerges from the buckle 302 so that if the locking surface 332 is viewed in lateral cross-section, the intermediate point 338 on the band 304 is a greater distance from the lower member 318 of the buckle 302 than the first point 336 and the second point 340. Further, in the lateral cross-section, the distance of the first point 336 on the first lateral edge 310*a* from the lower member 318 of the buckle 302 and the distance of the second point 340 from the lower member 318 are substantially equal. Stated another way, the lateral cross-section of the locking surface 332 is substantially Omega-shaped. Further, the portion of the band 304 is bent, deformed or otherwise processed to cause the intermediate edge 360 to be substantially even with the upper member 320 of the buckle 302. As before, the lock is created in a manner that largely circumvents any need to release tension in the band and relative rotation between the band and the clamped object and the thinning due to rotation.

One way to form the embodiment of the lock referred to in FIGS. 11A–11D is to use the Ω-knife 404 and Ω-blade 406 shown in FIGS. 15A–15D with the banding tool previously described. The Ω-knife 404 includes a first leg 408*a*, a second leg 408*b*, a buckle contact surface 410, band contact surface 412, and a first cutting edge 414 for cooperating with the Ω-blade 406 to produce the lock and sever excess band. The Ω-blade 406 includes a tongue 416 and a second cutting edge 418 for cooperating with the Ω-knife 404 to form the lock and trim any excess portion of the band 304.

With the Ω-knife 404 and Ω-blade 406 installed in the tool and with the band 304 appropriately tensioned by the tool, formation of the locking surface 332 commences with the Ω-knife 404 being displaced towards the Ω-blade 406 by the movement of the cut-off handle 154. As the Ω-knife 404 is displaced, the buckle contact surface comes into contact with the upper member 320 of the buckle 302 and the first and second legs 408*a*, 408*b* come into contact with the band 304. Further displacement of the Ω-knife 404 towards the Ω-blade 406 serves to form the locking surface 332. Specifically, further displacement of the Ω-knife 404 results in the first and second legs 408*a*, 408*b* of the Ω-knife 404 cooperating with the tongue 416 to form the locking surface 332 by displacing the portion of the band 304 located intermediate the first and second lateral edges 310*a*, 310*b* to be bent away from the lower member 318 of the buckle 302 in the characteristic Ω-shape. Also as a result of the bending, the portion of the band 304 immediately adjacent to the first exterior end surface 328*a* of the buckle 302 is cut from the first internal cutting point 362*a* to the second internal cutting point 362*b* to form the intermediate edge 360. This cut is caused by the bending of this portion of the band 304 forcing the first face 314*a* of the band 304 to contact the band cutting edge 396. The band cutting edge 396 is the interface of the interior surface 322 and upper member 320 of the buckle 302. The lock is now formed by the engagement of the locking surface 332 to the buckle 302 and more specifically, by the engagement between the intermediate edge 360 of the locking surface 332 and the first exterior end surface 328*a* of the buckle 302.

Consequently, all but a narrow portion of the excess band 304 is severed from the locking surface 332 during lock formation. More precisely, upon completing the lock, a portion of the band 304 between the tongue 416 and the Ω-knife 404 remains uncut. To completely detach the newly formed lock from the excess band portion, tension is again applied to the excess band portion by applying force to the pull up handle 116 in the direction 126. Note that prior to using the pull up handle 116, the tensioning assembly 24 my require adjusting such that this assembly can withstand greater tension, i.e., tension sufficient to tear way the excess band from the newly formed lock.

One way to form the embodiment of the lock referred to in FIGS. 12A–12D is to use, in the previously described banding tool, the Ω-knife 404 and Ω-blade 406 shown in FIGS. 15A–15D with the appropriate modifications to accommodate the lock cover 366. Particularly, the Ω-knife 404 is modified so that it substantially corresponds to the cross-sectional shape of the lock cover 366. When in operation the Ω-knife contacts the lock cover 366 as well as the upper member 320 of the buckle 302. In all other respects the use of the Ω-knife 404 and Ω-blade 406 in the banding tool to form the lock illustrated in FIGS. 12A–12D is identical to that previously described for forming the lock shown in FIGS. 11A–11D. Also, the lock is made in a fashion that largely circumvents the need to release tension in the band and relative rotation between the band and the clamped object and hence the thinning associated with rotation.

Figure 16:
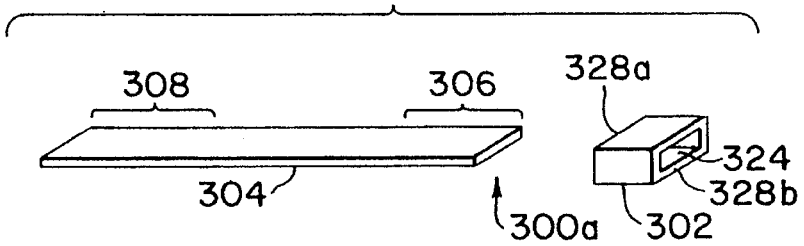
FIG. 16 illustrates an alternative embodiment of the band clamp where the buckle and the band are separated.
Figure 17:
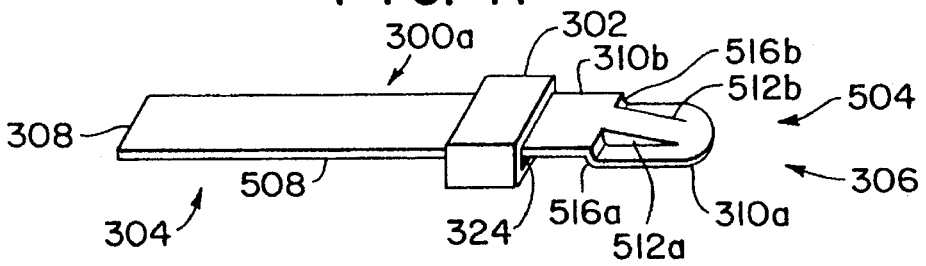
FIG. 17 represents the alternative embodiment of the band clamp with the band inserted into the detachable buckle and a buckle retaining member formed on one end of the band.
Figure 18:
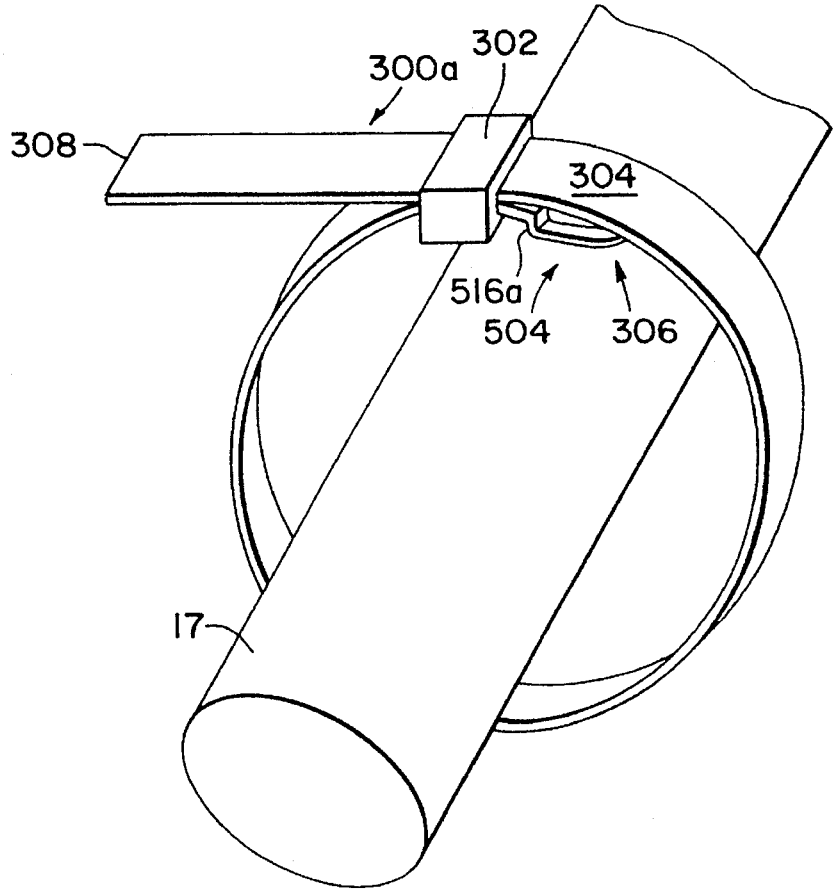
FIG. 18 illustrates wrapping the alternative embodiment of the band clamp about an object in preparation for using a banding tool.

In another embodiment of the present invention, various blade/knife configurations can be used in a dual purpose manner with a second embodiment of the band clamp hereinafter denoted band clamp 300*a* (as shown in FIGS. 16–18). That is, as shown in FIG. 16, the buckle 302 of band clamp 300*a* having a passageway 324, and first and second exterior end surfaces 328A, 328B, respectively, is no longer fixedly attached to the band 304. Instead, once the band 304 is inserted into the buckle passageway 324, a lock-like "retaining member" can also be formed by the banding tool 10 at the first end 306*a* of the band 304, as well as a lock on the second band end 308*a*. That is, the retaining member on the first end 306 is used to prevent the buckle 302 from sliding off the first end 306. The retaining member can be described in various alternative ways:

(1.1) a cross-section of the retaining member has points from the same face or surface of the band 304 that are not colinear;

(1.2) a cross-section of the retaining member has points within it such that a line segment between them has a portion outside the cross-section; or (1.3) the retaining member has at least one point on a face on the band 304 that both contacts the second exterior end surface 328*b* on the buckle 302 and is inwardly disposed toward the object being clamped further than the passageway 324.

These descriptors will be apparent to one skilled in the art from the discussion below.

As an example, in FIG. 17, one embodiment of a retaining member is presented, i.e., retaining member 504. In this configuration of a retaining member, band portions 512*a* and 512*b* adjacent to the first and second lateral edges 310*a* and 310*b*, respectively, of the first end 306 are misaligned from the remainder of the band 508. In particular, wedges 512*a* and 512*b* are formed such that the misalignments at the offset 516*a* and a similar offset 516*b* are sufficient, for all practical purposes, to prevent the band 304 from being removed from the buckle passageway 324 via first end 306. Thus, by wrapping the band 304 of band clamp 300*a* about, for example, shield 17, as shown in FIG. 18, and inserting the band second end 308 through the buckle passageway 324, the band first end 306 is sandwiched between the shield 17 and an extent of overlapping band 304. Note that such a band clamp embodiment when tightened about shield 17 provides an extremely secure tension maintaining connection at band first end 306 due to both contact between the buckle 302 and the offsets 516*a* and 516*b*, and the friction on the first end 306 resulting from being sandwiched between the shield 17 and the overlapping extent of band 304. Thus, given the configuration of band clamp 300*a* in FIG. 18, the banding tool 10 can be utilized as previously described by inserting band second end 308 into the banding tool 10 as shown in FIG. 3A.

The novel aspects relating to a banding tool 10 embodiment allowing both a lock and a retaining member to be formed reside substantially in (a) the cutoff blade 86 and cutoff knife 180 combination, and (b) enhancements in the method of operating the banding tool 10. Briefly, by using certain configurations of cutoff blade 86 and cutoff knife 180 combinations (as will be described below), a retaining member can be formed on a band first end 306 either by (2.1) inserting the first end 306 into the banding tool 10 in a forward direction 128 as in FIG. 3A (however, preferably not further than tension holding pin 92), or (2.2) inserting the first end 306 into the banding tool 10 in the reverse direction such that the band exit from the banding tool for an excess band portion cutoff upon band lock formation is now the insertion location for the band 304.

Thus, whether the first end 2106 is inserted forwardly or reversely, when the first end 306 (or a band 304 portion substantially near the first end 306) resides between the cutoff blade 86 and the cutoff knife 180 a retaining member can be formed. Note that either before or after the retaining member formation, the band 304 can be inserted into the buckle passageway 324 such that a band clamp 300*a* configuration as in FIG. 17 results thereby allowing an operator to proceed as discussed in FIG. 18 and subsequently use the banding tool 10 to form a band lock.

Figures 19A, 19B, 19C, 19D, 19E, 19F, 19G:
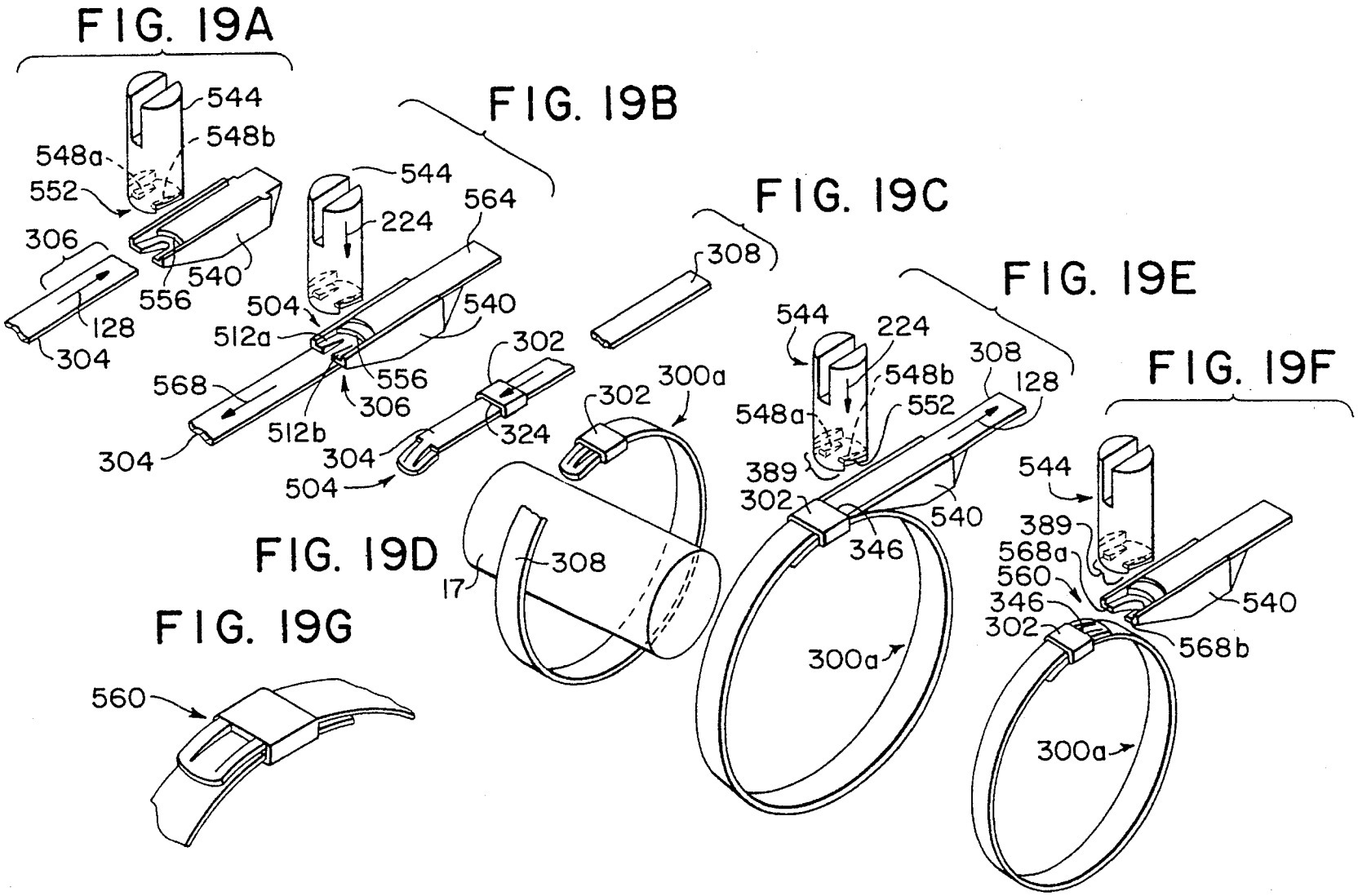
FIGS. 19A–19G illustrate a banding tool in which the knife and blade are used to form both the retaining member and subsequently the band lock.

For more detail in using the banding tool 10 for the dual purposes of forming both the retaining member and the band lock, reference is made to FIGS. 19A–19G. In these figures, note that the embodiment of the cutoff blade 86 and the cutoff knife 180 combination represented here, that is, blade 540 and knife 544, is distinct from the previous embodiments presented. In particular, substantially identical wedge indentations 548*a* and 548*b* formed on the band/buckle contacting surface 552 of the knife 544 provide a contour which results in wedge shaped portions of the band 304 being formed on the band as the knife 544 exerts a force in direction 224 thereby severing the band positioned between the knife 544 and blade 540 at the cutoff shear 556. For example, as indicated in FIGS. 19A and 19B, wedges 512*a* and 512*b* of FIG. 17 (upside down here) are formed on the first end 306 when this end is inserted between knife 544 and blade 540 along direction 128. In addition, in FIGS. 19E–19G, note that this same knife and blade combination also produces the wedge lock 560.

Thus, the operation of the banding tool 10 embodied in FIGS. 19A–19F can be described as follows. A band first end 306 is inserted forwardly (direction 128) into the banding tool 10 (FIG. 19A). Once the first end 306 is positioned to contact the entire band/buckle contacting surface 552, the cutoff handle 154 is rotated or activated in the direction 220 (FIG. 6A) and subsequently released to return its resting position. This action results in the configuration of FIG. 19B whereby the knife 544 has both severed, along cutoff shear 556, an excess band portion 564 from the band 304 and formed the wedges 512*a* and 512*b* of the retaining member on the (newly cropped) first end 306. Subsequently, the retaining member 504 is removed from the banding tool 10 by an operator pulling the band 304 in the direction 568 and (if not already inserted) the band 304 is inserted into the buckle passageway 324 via the second band end 308 as illustrated in FIG. 19C. Following this, the band 304 is wrapped about an object such as shield 17 to be banded as in FIG. 19D and, by subsequently inserting the second band end 308 back through the buckle passageway 324, the configuration of FIG. 18 is achieved. At this point, the banding tool 10 can be used to form a band lock 560 in a manner substantially similar to previous descriptions of band lock formations. That is, (i) an excess portion of the band 304 extending from the second end 308 to the buckle 302 is inserted in direction 128 into the banding tool 10 such that some portion of the band 304 is past the tension pin 78 via activation of tension hold hook 110 (FIGS. 3B and 19E), (ii) the tension hold hook 110 is used to restore the tension pins 78 and 92 to positions where tension can be applied to the band 304, (iii) the pullup handle 116 is subsequently reciprocated causing movement of the band 304 in direction 128 thereby tightening the band about the object to be banded and inherently causing the buckle be positioned immediately adjacent the blade 540 as in FIG. 19E, (iv) subsequently, once a predetermined tension on the band, pulling in the direction substantially opposite from the direction 128, is attained, the cutoff handle 154 is used to force knife 544 in direction 224. This last action thereby causes the buckle contact surface 389 (i.e., the portion of the band/buckle contacting surface 552 that contacts the buckle 302) to induce the cutting or shearing of the band 304 along the cutting edge 346 of the buckle 302 where this edge comes in contact with the blade projection ends 568*a*, 568*b* (FIG. 19F), thus forming the lock 560 of FIGS. 19F and 19G.

Figure 20:
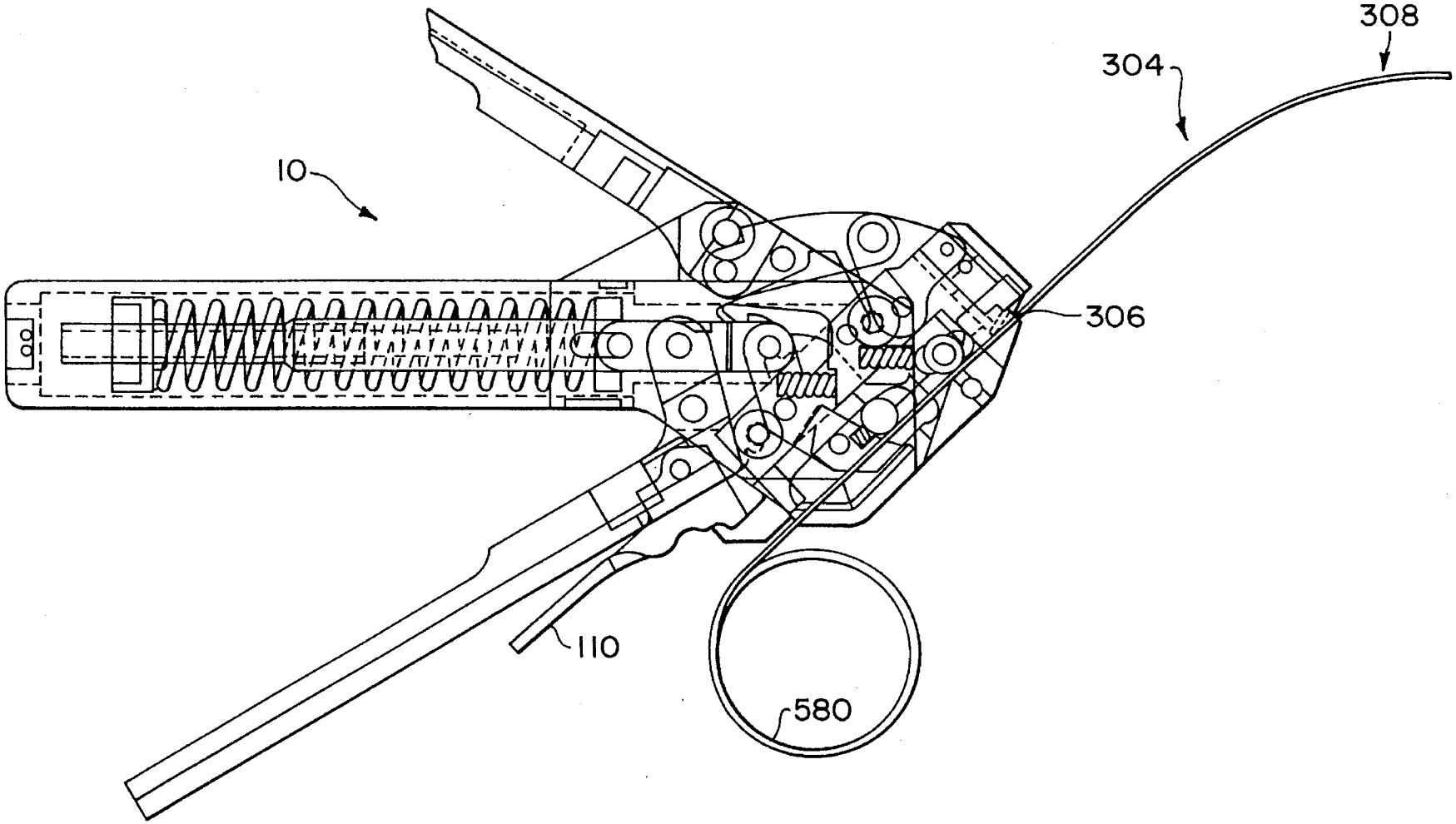
FIG. 20 illustrates an alternative method of using the banding tool 10 whereby the band 304 is inserted in a reverse direction.

In an alternative method of using the banding tool 10 embodiment to form a retaining member, instead of inserting the band first end 306 into the banding tool 10 as shown in FIG. 19A, the band 304 can be threaded reversely through the tool. For example, FIG. 20 illustrates a substantial coil of band material 580 that is threaded in the direction 216 through the band tool 10. In this procedure, the tension hold hook 110 is used to form the gaps G of FIG. 3B whereby a band end can be inserted as shown in FIG. 20. Subsequently, a length of band 304 sufficient to create the band clamp 300*a* is drawn out the previous band entry location adjacent or between the knife 544 and the blade 548. Consequently, since the portion of the band between the knife 544 and blade 540 can be considered the first end 306 of the band 304 portion drawn out of the previous band entry, the remainder of the procedure described in reference to FIGS. 19A–19G applies. Therefore, the band clamp 300*a* can be locked about an object as indicated in FIGS. 19A–19G.

The Ω-knife 404 and Ω-blade 406 can also be used with the alternative band clamp 300*a*. For example, by inserting the band clamp 300*a* in the reverse direction as described in (1.2) and shown in FIG. 20, the band 304 can be positioned between the Ω-knife 404 and the Ω-blade 406 as presented in FIGS. 21A–21C. Thus, a force on the Ω-knife 404 in the direction 224 causes the retaining member 600 to be formed on the first end 306. Subsequently, when the Ω-knife 404 is disengaged from the band 304, a sufficient length of band to form a desired band clamp can be drawn through the banding tool 10 in the direction 604 and cut off (without using the banding tool 10). Following this, the cutoff length of band drawn out of the banding tool 10 can be inserted into a buckle passageway 324 to obtain the band clamp 300*a* of FIG. 21C.

Figures 21A, 21B, 21C:
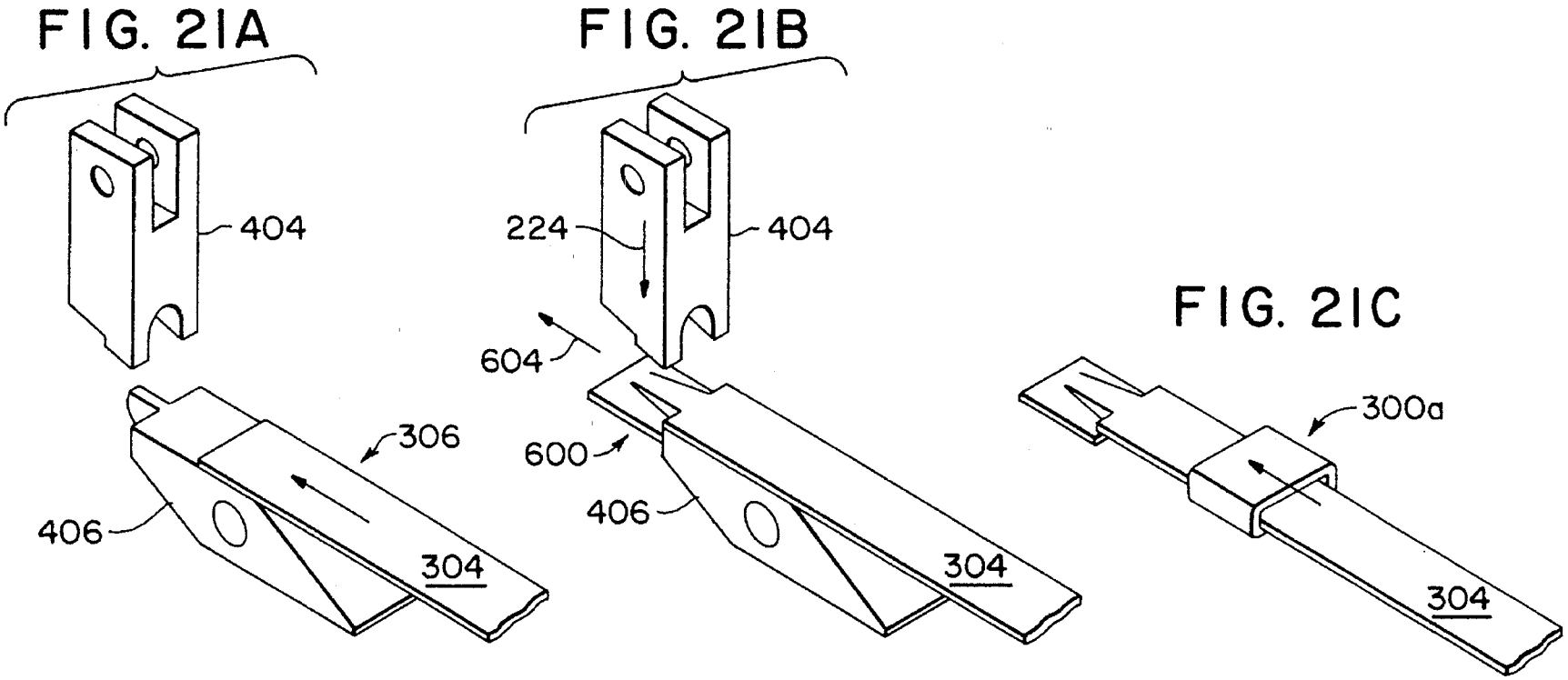
FIGS. 21A–21C illustrate the use of the Ω-knife 404 and Ω-blade 406 in forming a retaining member.
Figures 22A, 22B, 22C, 22D:
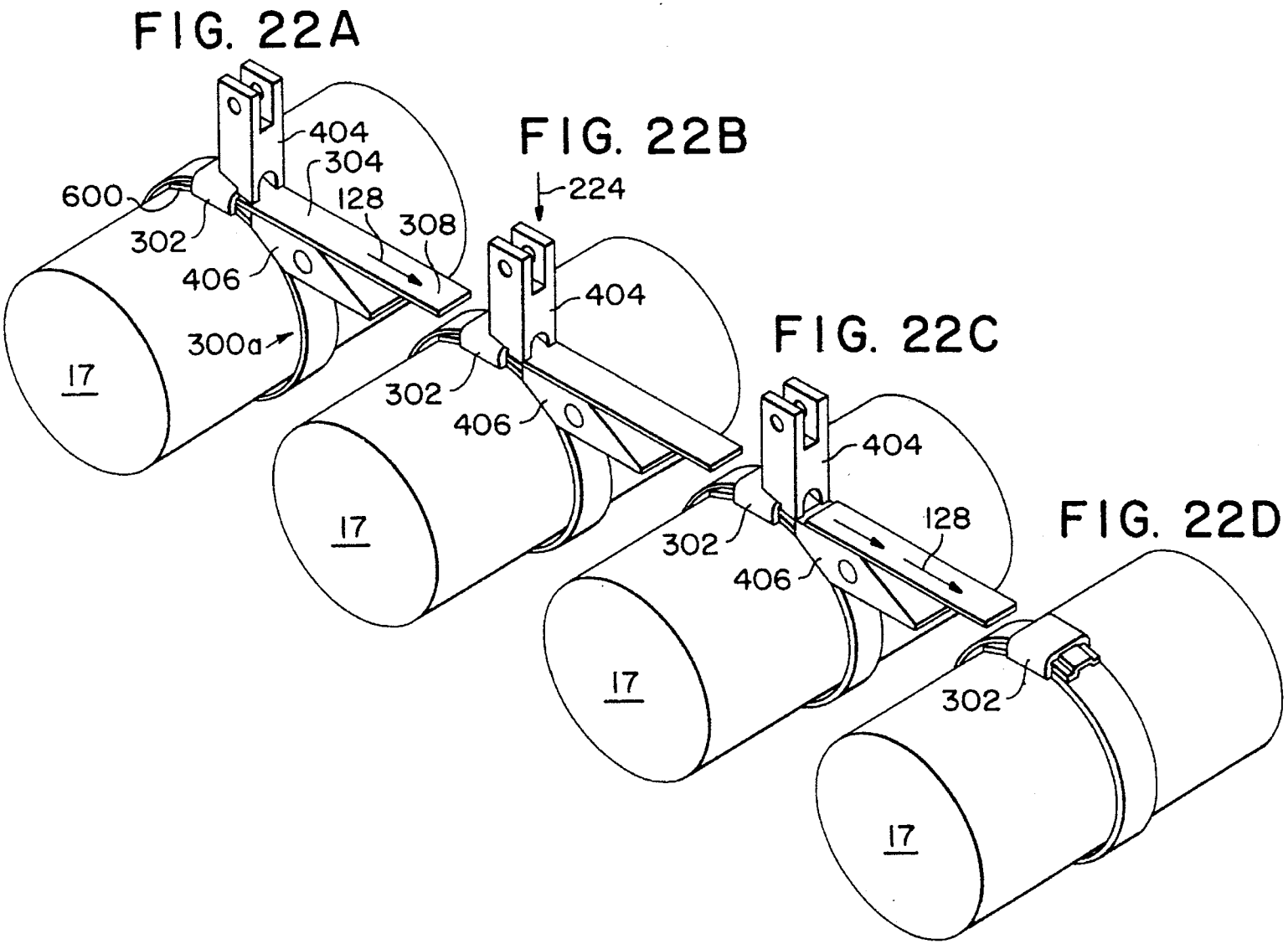
FIGS. 22A–22D illustrate the sequence of steps performed in using the Ω-knife 404 and Ω-blade 406 to form a lock.

Referring now to FIGS. 22A–22D, the newly formed band clamp 300*a* can now be wrapped around an object, such as shield 17, and the second end 308 can be inserted into the banding tool 10 in the forward direction 128 as in FIG. 21A by using the tension hold hook 110 to create gap G (FIG. 3B). Subsequently, the band clamp 300*a* can be tightened about the object and the lock of FIGS. 11A–11D can be formed in the manner described above in reference to FIGS. 15A–15D. Thus, the sequence of FIGS. 22A–22D illustrate how to form the lock using the Ω-knife 404 and Ω-blade 406 in the banding tool 10.

FIGS. 23–28 present an alternative embodiment of the banding tool which is particularly suited for use with the Ω-knife 404 and Ω-blade 406. This alternative banding tool, hereinafter denoted banding tool 650, is manually operated as with banding tool 10. However, substantially all forces required for band insertion, tensioning, lock forming and band cutting (or tearing) are supplied pneumatically.

Figure 23:
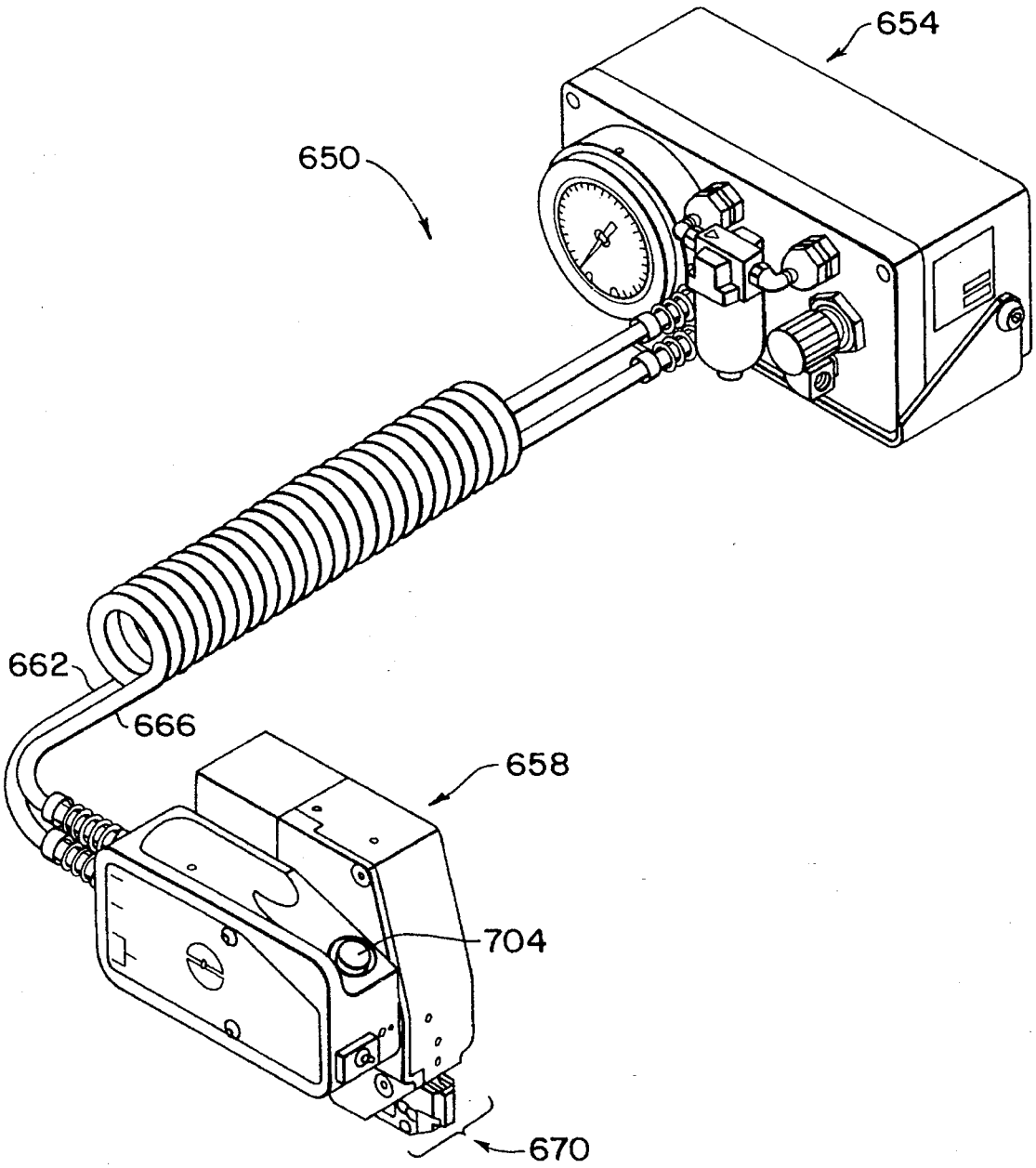
FIG. 23 illustrates a further alternative embodiment of the present invention in which the banding tool is a pneumatic device.

In FIG. 23, the banding tool 650 is shown. The tool includes an air pressure controller 654, a hand held lock forming unit 658 and two pneumatic hoses 662, 666 for conveying pressurized air from the controller 654 to the lock forming unit 658, with hose 662 providing high substantially unregulated pressure while hose 666 provides regulated pressure.

Figure 24:
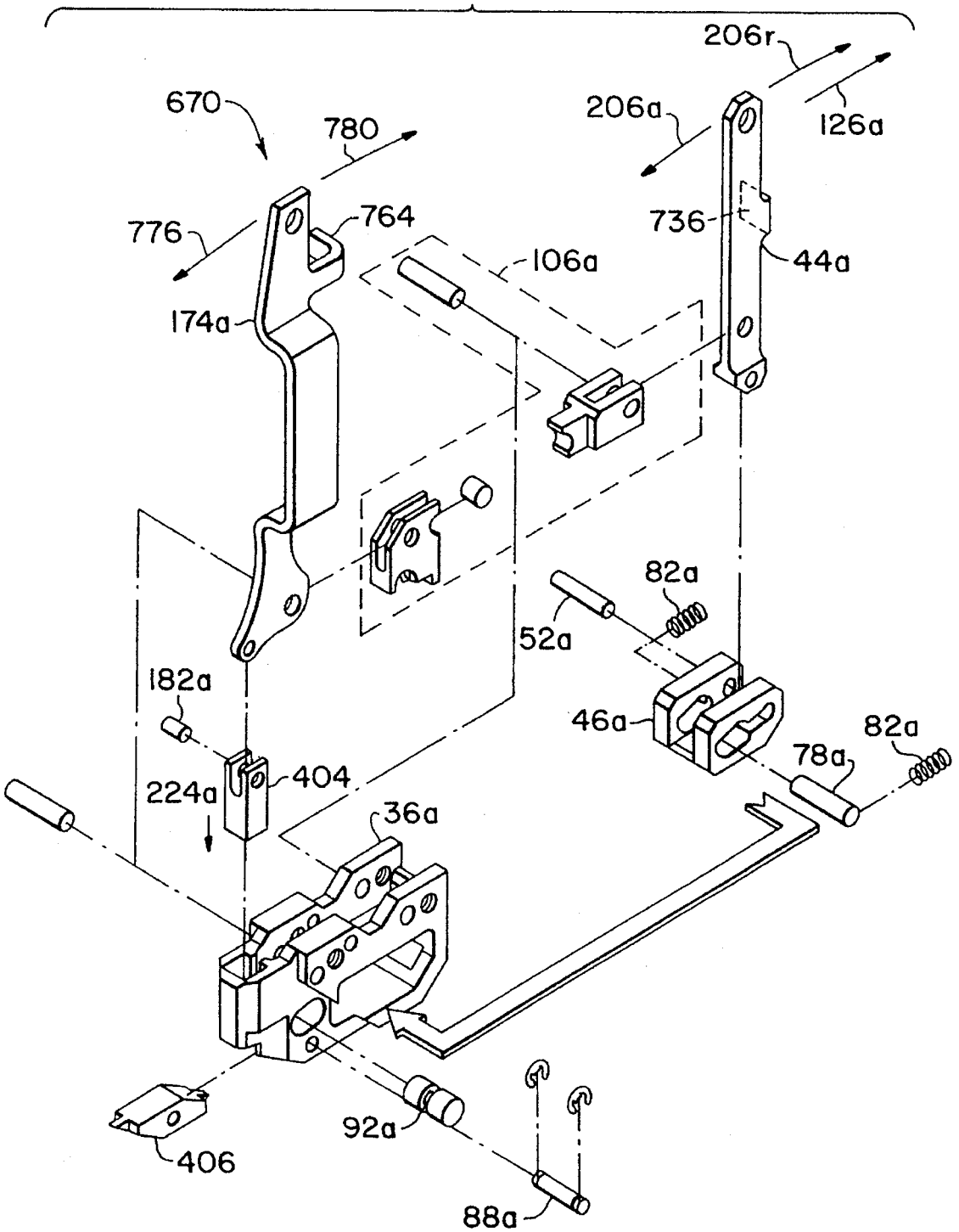
FIG. 24 is an exploded view of the band contacting assembly of the pneumatic embodiment of the banding tool.

Referring to lock forming unit 658, FIG. 23 shows a band lock head assembly 670 which includes substantially all band contacting components; e.g., the band tensioning and lock forming components. In particular, head assembly 670 provides substantially the same functionality as head 36 and those components of banding tool 10 directly connected to and/or included within head 36. More precisely, an expanded view of the components of lock head assembly 670 are presented in FIG. 24. Note that labelings having an "a" in FIG. 24 are intended to be substantially analogous to the similarly labeled component or direction in the banding tool 10 without an "a" in the labeling. In addition, direction label 206*r* is intended to denote the direction analogous to the reverse or counter-clockwise direction to 206 of FIG. 4B.

Figure 25:
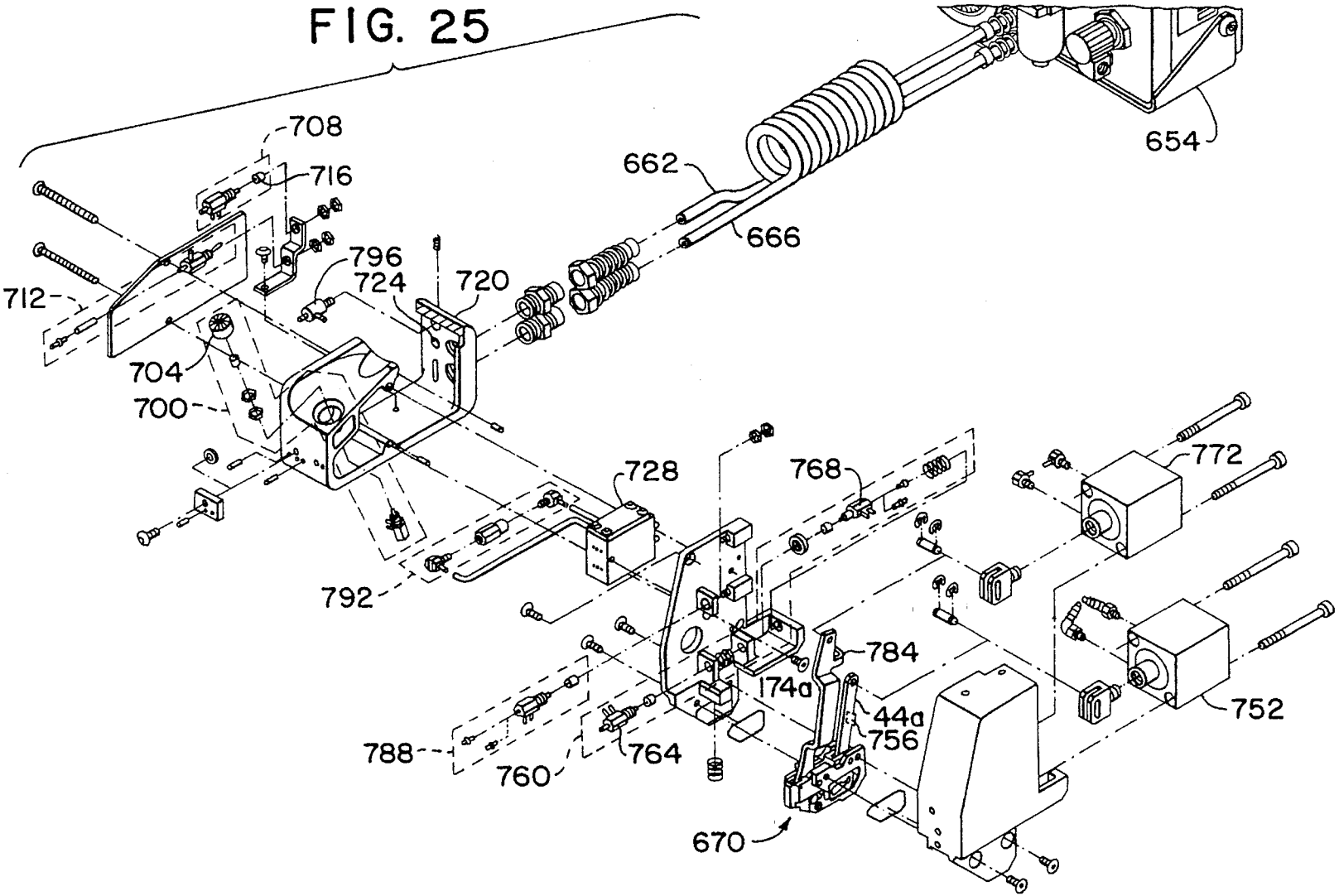
FIG. 25 is an exploded view of the components of the lock forming unit 658 of the pneumatic banding tool of the present invention.
Figure 26:
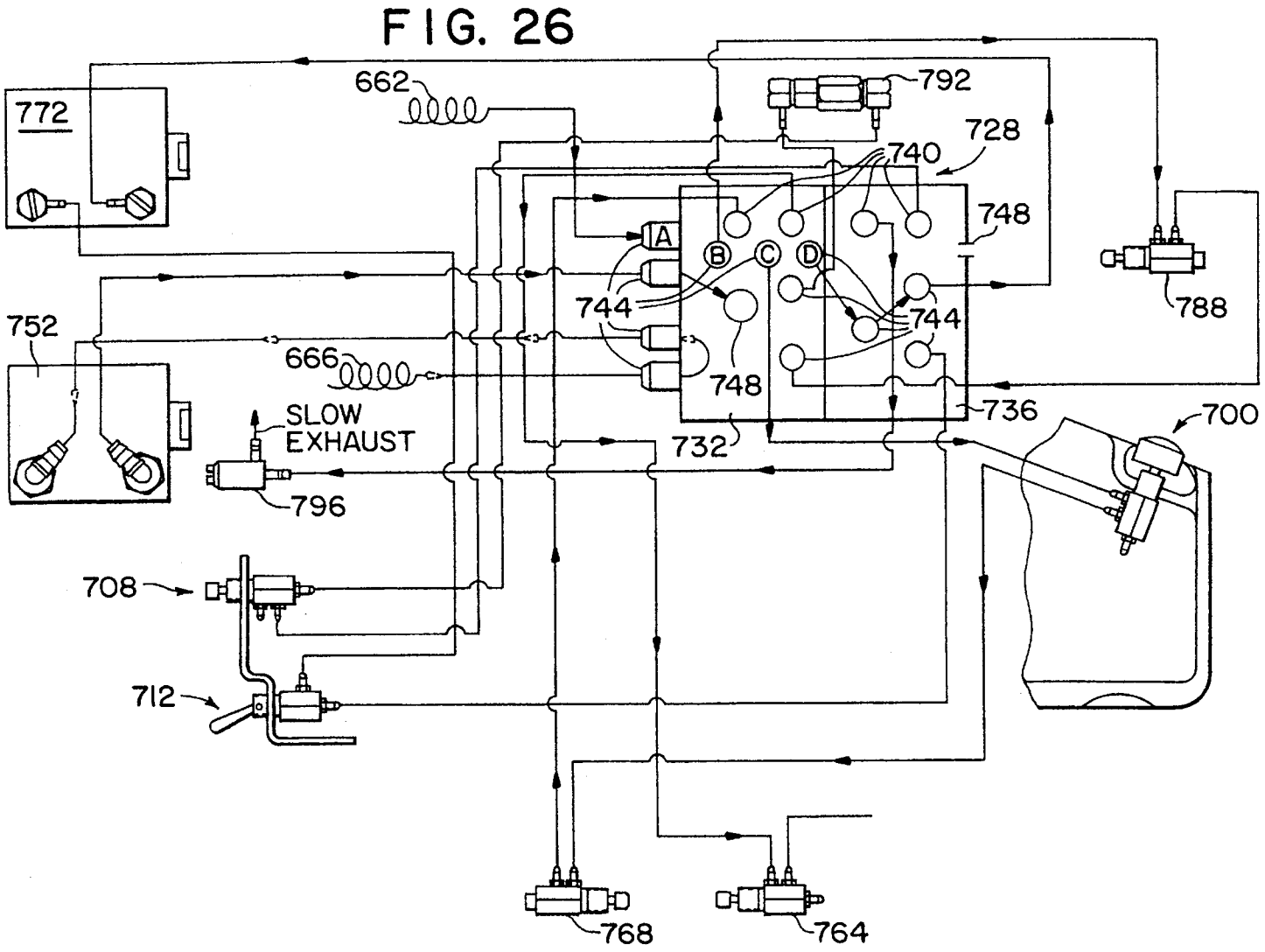
FIG. 26 illustrates schematically air flows between components of the lock forming unit 658 during the tensioning of a band clamp prior to lock formation.
Figure 27:
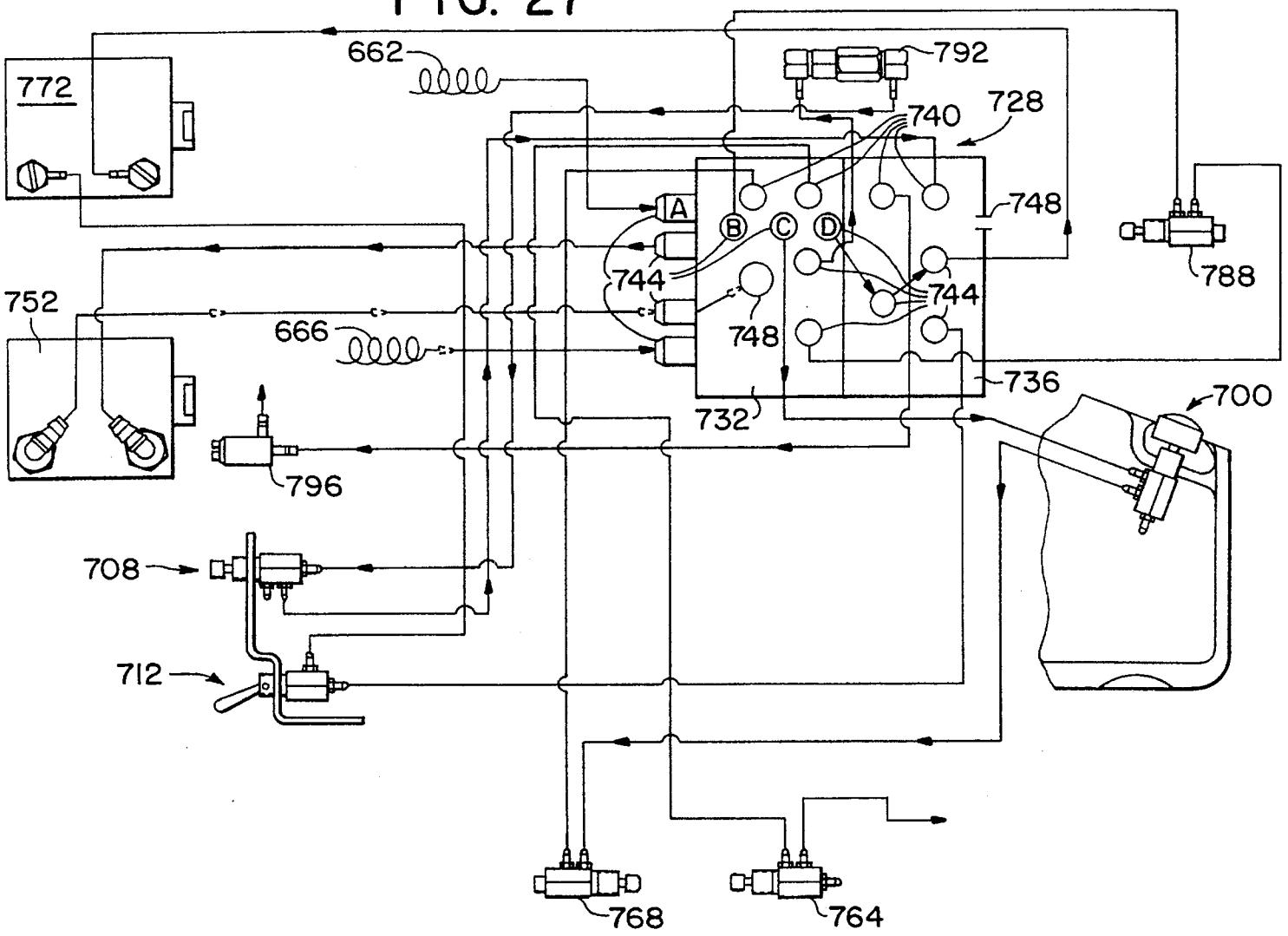
FIG. 27 illustrates the pneumatic interactions between components of the lock forming unit 658, which alternates iteratively with the configuration of FIG. 26, and is used in maintaining tension on a band 304.
Figure 28:
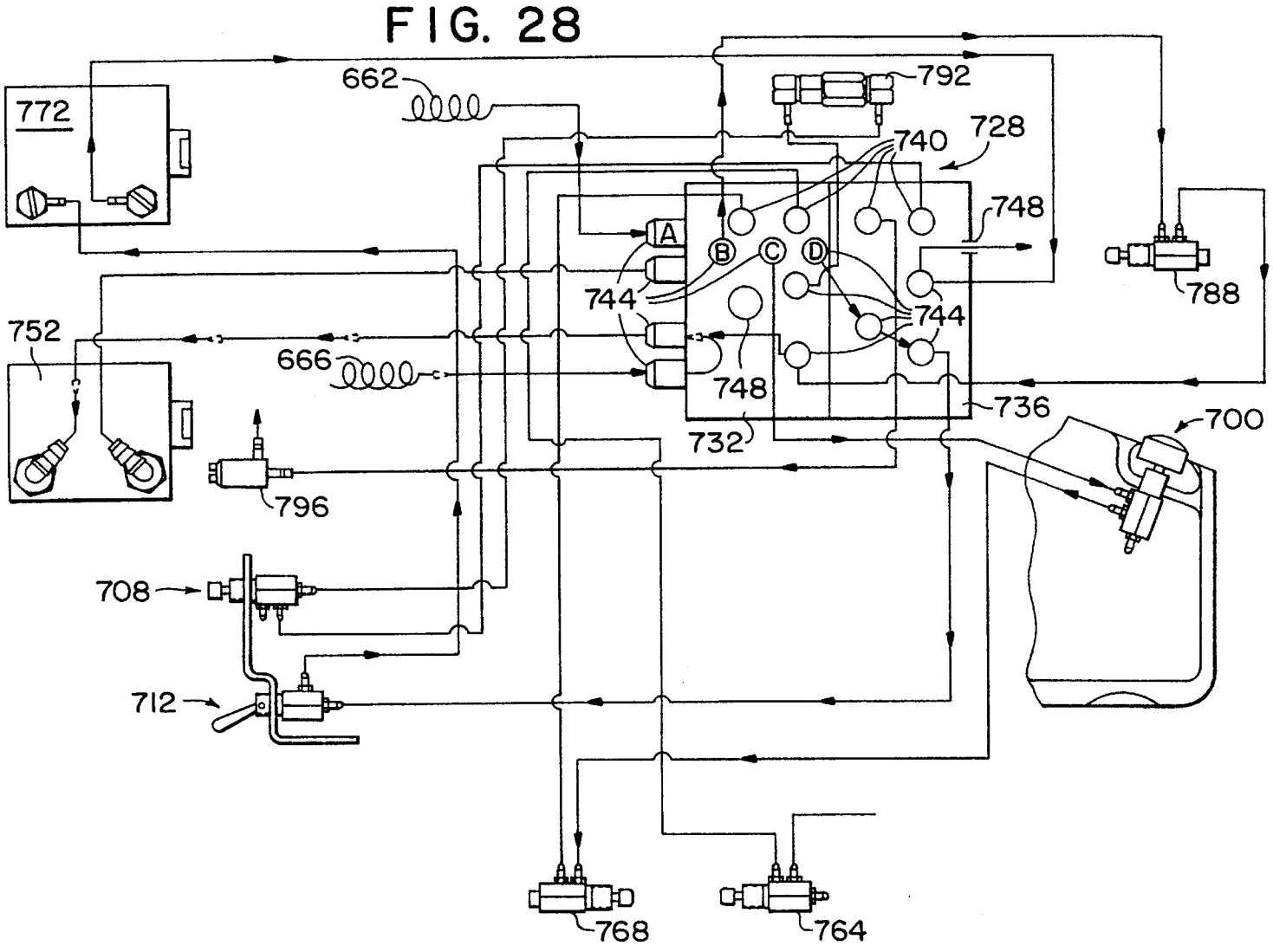
FIG. 28 illustrates the pneumatic interactions between the components of the lock forming unit 658 during lock formation.

FIG. 25 shows an expanded view of the components of the lock forming unit 658 while FIGS. 26–28 show the pneumatic connections and flows between various components of lock forming unit 658. That is, FIG. 26 shows the airflows between the lock forming unit 658 components during the tensioning of a band 304 when lever 44*a* moves in direction 206*a*. FIG. 27 shows the airflows between the lock forming unit 658 components as the lever 44 moves in the direction 206*r*. And, FIG. 27 shows the airflows during lock formation.

Given the description of the lock forming unit 658 components below, it is left to those skilled in the art to fully appreciate the pneumatic interactions between the components. However, it is worth mentioning that the dashed arrows used in FIGS. 26–28 indicate a direction for the flow of regulated pressure initially obtained from hose 666 and the solid arrows indicate a direction for the flow of high substantially unregulated pressure initially obtained from hose 662.

In FIG. 25, the components of the lock forming unit 658 relating to the pneumatic control of the lock head assembly 670 will now be discussed. Tension activating assembly 700 is used for activating the tensioning of a band 304 (band not shown in FIG. 25). That is, whenever the tension activating assembly button 704 (also shown in FIG. 23) remains depressed, the tension activating assembly 700 causes regulated air pressure from line 666 to be used in tensioning a band clamp inserted into the lock head assembly 670 as in FIGS. 22A–22D. Further, whenever the button is not depressed, a gap analogous to gap G (FIG. 3B) is formed in the lock head assembly 670 for easy insertion of a band.

Other operator controls included in the lock forming unit 658 are a retaining member formation switch 708 and a tear off tension disable switch assembly 712. The retaining member formation assembly 708 is used for activating the appropriate pneumatic components such that a retaining member is formed on a band 304, in particular, without a predetermined band tension and without subsequent tear off tension. Note that the button 716 extends through the control housing 720 at hole 724. The tear off tension disable switch assembly is used to allow an operator to experiment with various band tensions about an object prior to committing to forming a lock.

Each of the above-mentioned operator controls are pneumatically connected to a pneumatic internal control 728 as the pneumatics schematics of FIGS. 26–28 indicate. The internal controller 728 includes two conventional pneumatically controlled cylinder-piston combinations 732, 736 (FIGS. 26–28) for routing pressurized air between the operator controls and the various internal pneumatic switches and pneumatic cylinders. In particular, there are three types of air ports for attachment to the internal controller 728. Air ports 740 control the routing of air flow through substantially all other air ports. Air ports 744 communicate air between the operator controls and the various internal pneumatic devices. Note that ports 744*a*, 744*b*, 744*c* and 744*d* are in continual pneumatic communication with one another. Finally, air ports 748 are exhaust ports for exhausting air into the environment.

Connected to the internal controller 728 is a two-way activated pneumatic cylinder 752, hereinafter denoted the tensioning cylinder, which supplies the forces to move the lever 44a in the directions (and corresponding magnitude) of the arrows 206*a*, 206*r* and 126*a*. Thus, when the tensioning cylinder 752 toggles the lever 44*a* according to direction arrows 206*a* and 206*r*, the tension block 46*a* increases the tension on a band 304 in the same manner as the tension transfer block 46 of the banding tool 10. In this context, to reverse movement of lever 44*a* between directions 206*a* and 206*r*, a tab portion 756 (also see FIG. 24) contacts a dual switch valve controller, hereinafter denoted the tension switch assembly 760, having pneumatic switches 764 and 768. That is, the tab portion 756 contacts switches 764 and 768 alternately during tensioning of a band 304. As can be seen in FIG. 26, both switches 764 and 768 are pneumatically connected to the internal controller 728 which, in turn, routes air pressure from the switches to the tensioning cylinder 752 to induce toggling of the lever 44*a*.

The internal controller 728 is also pneumatically connected to a second two-way activated pneumatic cylinder 772, hereinafter denoted the knife activation cylinder, which is substantially identical to the tensioning cylinder 752. Upon impetus of receiving pressurized air from the internal controller 728, the knife activation cylinder 772 supplies the forces to move the lever 174*a* in the directions 776 and 780 (FIG. 24). Thus, when the lever 174*a* is induced to move in the direction 776, the knife 404 moves to engage the blade 406 (i.e., moves in direction 224*a*) and when the lever 174*a* is induced to move in the direction 780, the knife 404 moves in substantially the opposite direction thereby disengaging from the blade 406. Further note, when the lever 174*a* moves sufficiently forward such that the knife 404 fully engages the blade 406, tab portion 784 contacts pneumatic knife disengage switch 788 which induces the lever 174*a* to move in direction 780. That is, activation of the knife disengage switch 788 induces pressurized air to flow through the switch 788 and between two air ports 744 of the internal controller 728 such that pressurized air is in turn communicated to the knife engaging cylinder 772 to induce movement of the lever 174*a* in direction 780. Moreover, in this context, activation of knife disengage switch 788 also induces, via internal controller 728, activation of the tensioning cylinder 732 with unregulated air pressure to pull the lever 44*a* in the direction 206*a* such that the tension being communicated via tension transfer block 46*a* to a band 304 is increased sufficiently (in direction 128, FIG. 21C) to tear away the excess band from the lock.

The timing for commencing engagement between the knife 404 and the blade 406 is governed by check valve assembly 792 and needle valve 796. That is, once the predetermined tension has been obtained for forming a lock, or the retaining member formation switch 708 has been activated, there is an operator controllable time delay prior to the activation of the knife 404 to engage the blade 406. To accomplish this, the check valve assembly 792 communicates one way air pressure from the cylinder-piston combination 732 to a piston control portion of cylinder-piston combination 736 periodically. However, when the pressure in this piston control portion decreases to a predetermined level by escaping through needle valve 796, air flow commences to the knife engaging cylinder 772 resulting in the engagement of the knife 404 and blade 406.

Figure 29:
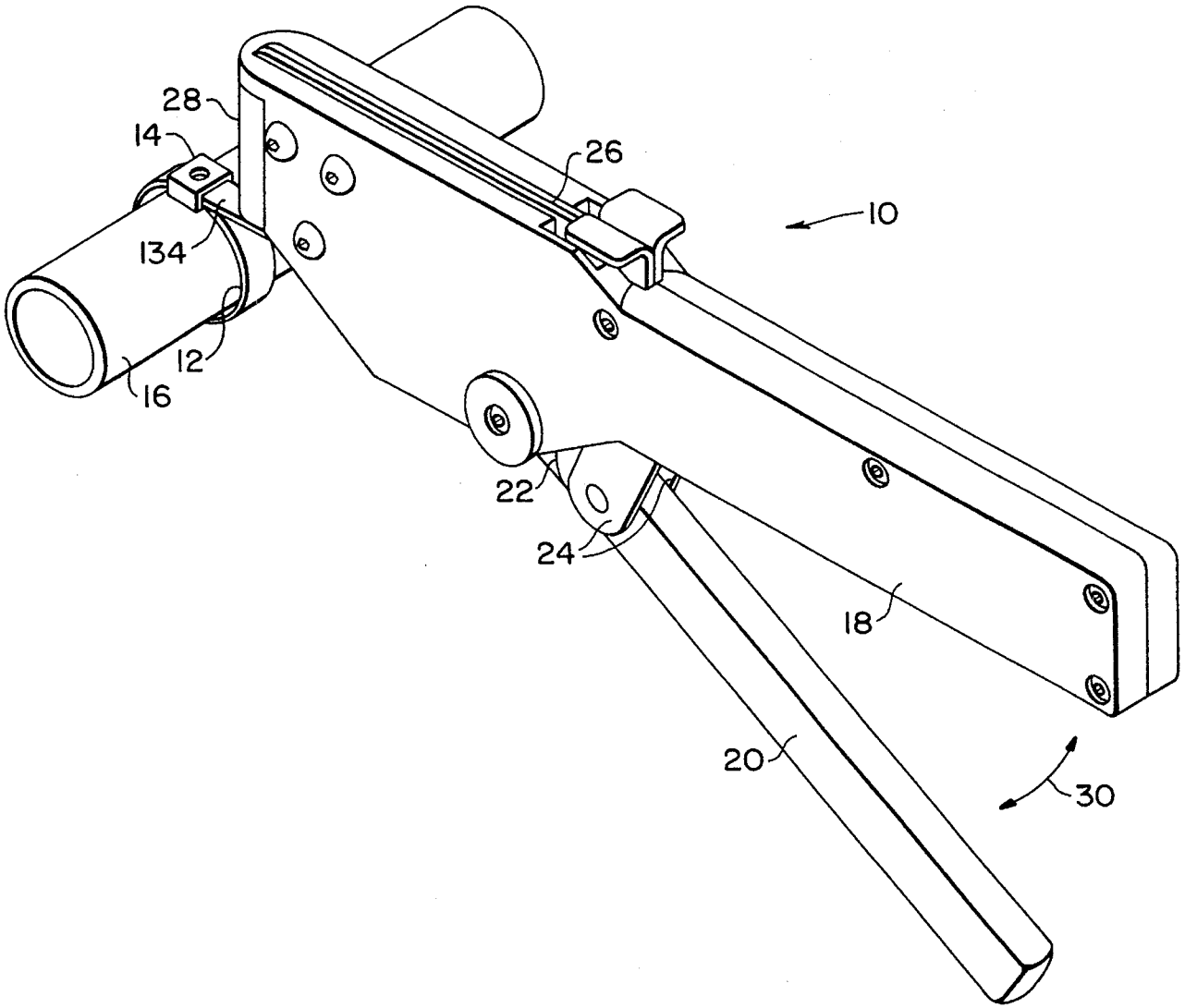
FIG. 29 is an oblique view of an alternative embodiment of a banding tool 10 to which the present invention pertains.
Figure 30:
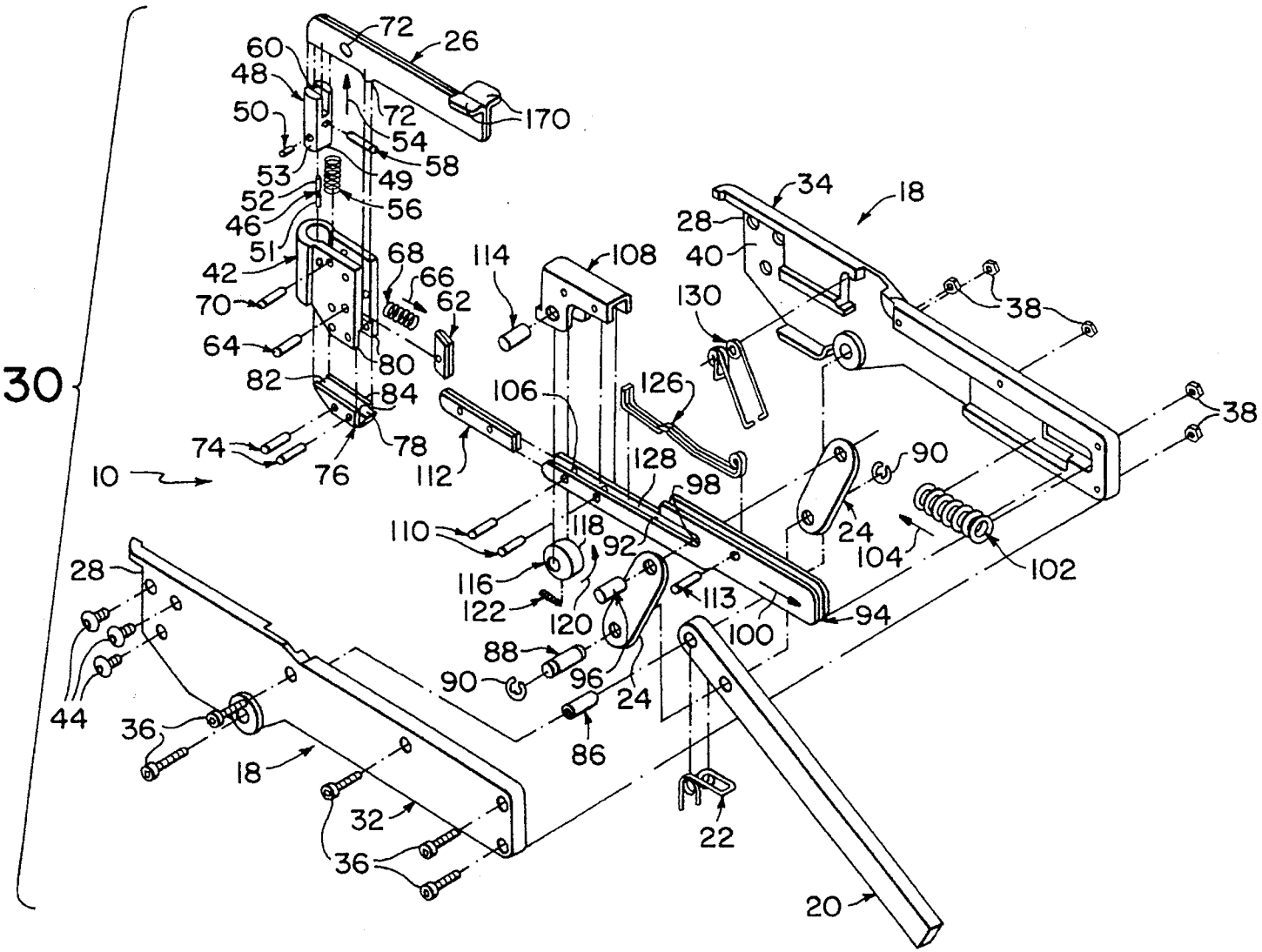
FIG. 30 is an exploded view of the banding tool 10 of FIG. 29.

FIGS. 29 and 30 present an external and exploded view, respectively, of another embodiment of a banding tool 10 wherein the blade 540 and knife 544 configuration of FIGS. 19A–19G can be used. In particular, the blade 76 and the knife 48 of FIG. 30 can be modified to provide the blade and knife configuration of FIGS. 19A–19G. That is, the band/buckle contacting surface 552 (FIG. 19A) can be provided on the lower surface 53 of FIG. 30 and the blade 540 configuration having blade projection ends 568*a* and 568*b* can be provided on the blade tip 82 of FIG. 30. Note that a full description of the banding tool 10 disclosed in FIGS. 29 and 30 is provided in U.S. Pat. No. 5,123,456 to Jansen issued Jun. 23, 1992 which is hereby incorporated by reference.

Although the present invention has been described with respect to a specific preferred embodiment thereof, various changes and modifications may be suggested to one skilled in the art and it is intended that the present invention encompass such changes and modifications as fall within the scope of the appended claims.

What is claimed is:

1. A method for clamping an object comprising:

providing a set of one or more tools, each tool of said set for producing both a retaining member and a lock for clamping a banding material about an object to form a band wherein, in using one or more tools of said set to provide a band clamp, the following steps (A1) through (A5) are performed:

(A1) providing a first banding amount of the banding material having a longitudinal axis extending from a first end to a second end, said first banding amount also having a first lateral edge and a second lateral edge both extending between said first end and said second end;

(A2) forming a retaining member on said first end using a tool of said set, wherein a cross-section of said retaining member, between a first point on said first lateral edge and a second point on said second lateral edge substantially opposite to said first point relative to said longitudinal axis, includes two points such that a line of points between said two points has a third point outside said cross-section;

(A3) positioning a buckle adjacent to said retaining member;

(A4) disposing said first banding amount with said buckle about an object; and (A5) creating a lock, with said first banding amount, using a tool of said set, said step of creating said lock being conducted subsequent to said step of forming said retaining member.

2. A method, as claimed in claim 1, wherein said step of forming includes:

placing said first band end between a first band contacting portion of said first tool component and a second band contacting portion of a :second tool component of said tool;

forcing said first and second band contacting portions together for deforming said first end to form said retaining member.

3. A method, as claimed in claim 2, wherein:

said tool of said set includes a knife and a blade.

4. A method, as claimed in claim 2, wherein:

said first band contacting portion interacts with said second band contacting portion for cutting the band.

5. A method, as claimed in claim 1, wherein:

said tool does not contact the buckle when forming said retaining member and said tool contacts the buckle when forming the lock.

6. A method, as claimed in claim 1, wherein:

said retaining member contacts an exterior end portion of the buckle for inhibiting a separation of the band and the buckle.

7. A method, as claimed in claim 1, wherein:

said retaining member includes an abrupt discontinuity in a surface of the band for contacting the buckle and inhibiting a separation of the band and the buckle.

8. A method, as claimed in claim 1, wherein:

said step of creating includes tearing an excess band portion from the lock by increasing band tension along said longitudinal axis.

9. A method, as claimed in claim 1, wherein:

said step of creating includes inducing movement of said tool of said set using pneumatic force means.

10. A method, as claimed in claim 1, wherein:

said step of forming includes inducing movement of said tool of said set using a pneumatic cylinder.

11. A method, as claimed in claim 10, wherein:

said pneumatic means includes a pneumatical cylinder.

12. A method, as claimed in claim 1, wherein:

said step of creating includes urging said tool of said set toward the band using a first pneumatic cylinder and separating the lock from an excess band portion using a second pneumatic cylinder.

13. A method, as claimed in claim 1, wherein:

during said step of forming, band tension along said longitudinal axis remains substantially the same.

14. A method for clamping an object comprising:

providing a band having a longitudinal axis extending from a first end to a second end, said band also having a first lateral edge and a second lateral edge both extending between said first end and second end;

forming a retaining member on said first end using a tool having at least a first tool component, wherein a cross-section of said retaining member, between a first point on said first lateral edge and second point on said second lateral edge substantially opposite to said first point relative to said longitudinal axis, includes two points such that a line of points between said two points has a third point outside said cross-section, said step of forming including placing said first band end between a first band contacting portion of said first tool component and a second band contacting portion of a second tool component of said tool and forcing said first and second band contacting portions together for deforming said first end to form said retaining member;

positioning a buckle adjacent to said retaining member;

disposing the band with said buckle about an object; and creating a lock using at least one of: said first tool component and a tool component that is structurally the same as said first tool component, said lock created subsequent to said retaining member, said step of creating includes urging said first and second band contacting portions together with a portion of the band different from said first end therebetween so that said portion of the band creates said lock.

15. A method, as claimed in claim 14, wherein:

said step of forcing deforms the band in a first direction and said step of urging deforms the band in a second direction, said first and second directions being substantially opposite.

16. A method for clamping an object comprising:

providing a set of one or more tools, each tool of said set for producing both a retaining member and a lock for clamping a banding material about an object to form a band clamp;

wherein, in using one or more tools of said set to provide a band clamp, the following steps (B1) through (B5) are performed:

(B1) providing a portion of the banding material, said portion having (i) a longitudinal axis extending from a first end to a second end, (ii) a first lateral edge and a second lateral edge both extending between said first end and said second end, and (iii) a band face extending between the first lateral edge and the second lateral edge;

(B2) forming a retaining member on said first end using a tool of said set, said retaining member including a first point on the band face substantially at the first lateral edge, a second point on the band face substantially at the second lateral edge, said second lateral point substantially opposite to said first point relative to said longitudinal axis, and a third point on the band face intermediate to said first point and said second point;

(B3) positioning a buckle adjacent to said retaining member, said buckle having a lower surface;

(B4) disposing said portion of the banding material with said buckle about an object;

(B5) creating a lock, with said portion of the banding material, using a tool of said set, said step of creating said lock being conducted subsequent to said step of forming said retaining member;

wherein said first point is a first distance from said lower surface and said third point is a third distance from said lower surface that is different from said first distance.

17. A pneumatic tool for providing a band clamp comprising:

first and second band contacting components for forming, in a first mode of operation, a retaining member when a first portion of a band is therebetween and, in a second mode of operation, a lock when a second portion of the band is therebetween, said second mode of operation being conducted subsequent to said first mode of operation in providing said band clamp;

pneumatic means for controlling at least one of engaging and disengaging said first and second band contacting components when forming the retaining member and when forming the lock.

18. A tool, as claimed in claim 17, wherein:

said first and second band contacting components include a knife and blade, respectively.

19. A pneumatic tool for forming a retaining member on a band clamp comprising:

first and second band contacting means for forming, in a first mode of operation, a retaining member when a band is therebetween and, in a second mode of operation, a lock when the band is therebetween; and pneumatic means for controlling at least one of engaging and disengaging said first and second band contacting components when forming the retaining member and when forming the lock, said pneumatic means including first and second pneumatic cylinders, said first pneumatic cylinder used for forming the retaining member, said first and second pneumatic cylinders used for forming the lock and severing an excess portion of the band from the band clamp.

* * * * *